US011883876B2

(12) United States Patent
Cordill et al.

(10) Patent No.: US 11,883,876 B2
(45) **Date of Patent: *Jan. 30, 2024**

(54) DYNAMIC MOLD SHAPE CONTROL FOR DIRECT CHILL CASTING

(71) Applicant: WAGSTAFF, INC., Spokane Valley, WA (US)

(72) Inventors: Craig Richard Cordill, Liberty Lake, WA (US); Craig Lee Shaber, Liberty Lake, WA (US); Michael Kim Anderson, Otis Orchards, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/658,269

(22) Filed: Apr. 7, 2022

(65) Prior Publication Data

US 2022/0226884 A1 Jul. 21, 2022

Related U.S. Application Data

(63) Continuation of application No. 16/621,125, filed as application No. PCT/IB2018/054214 on Jun. 11,
(Continued)

(51) Int. Cl.
*B22D 11/049* (2006.01)
*B22D 11/04* (2006.01)
(Continued)

(52) U.S. Cl.
CPC ..... *B22D 11/049* (2013.01); *B22D 11/001* (2013.01); *B22D 11/0406* (2013.01);
(Continued)

(58) Field of Classification Search
CPC ..... B22D 11/00; B22D 11/001; B22D 11/04; B22D 11/0406; B22D 11/049;
(Continued)

(56) References Cited

U.S. PATENT DOCUMENTS 2,871,534 A * 2/1959 Wieland ..... B22D 11/049 164/478
3,292,216 A 12/1966 Colombo
(Continued)

FOREIGN PATENT DOCUMENTS

AR 014307 2/2001
AR 017793 10/2001
(Continued)

OTHER PUBLICATIONS

Office Action for Brazil Application No. BR112019026131-1 dated Jul. 4, 2022 (4 pages).
(Continued)

*Primary Examiner* — Kevin P Kerns
(74) *Attorney, Agent, or Firm* — Alston & Bird LLP

(57) ABSTRACT

Provided herein is a system, apparatus, and method for continuous casting of metal, and more particularly, to a mechanism for controlling the shape of a direct chill casting mold to dynamically control a profile of an ingot cast from the mold during the casting process. Embodiments may provide an apparatus for casting material including: first and second opposing side walls; first and second end walls extending between the first and second side walls, where the first and second opposing side walls and the first and second opposing end walls form a generally rectangular shaped mold cavity. At least one of the first and second opposing side walls may include two or more contact regions, where each of the two or more contact regions may be configured to be displaced relative to a straight line along the side wall.

20 Claims, 17 Drawing Sheets

Related U.S. Application Data

2018, now Pat. No. 11,331,715, which is a continuation-in-part of application No. 15/619,866, filed on Jun. 12, 2017, now Pat. No. 10,350,674.

(51) Int. Cl.

| | |
|---|---|
| ***B22D 11/055*** | (2006.01) |
| ***B22D 11/124*** | (2006.01) |
| ***B22D 11/16*** | (2006.01) |
| ***B22D 11/00*** | (2006.01) |
| ***B22D 11/05*** | (2006.01) |

(52) U.S. Cl.

CPC ..... *B22D 11/05* (2013.01); *B22D 11/055* (2013.01); *B22D 11/124* (2013.01); *B22D 11/168* (2013.01)

(58) Field of Classification Search

CPC ..... B22D 11/05; B22D 11/055; B22D 11/124; B22D 11/16; B22D 11/168

USPC ..... 164/418, 436, 491, 444, 487

See application file for complete search history.

(56) References Cited

U.S. PATENT DOCUMENTS

| | | | |
|---|---|---|---|
| 3,537,507 | A | 11/1970 | Rossi et al. |
| 3,911,996 | A | 10/1975 | Villette |
| 4,030,536 | A | 6/1977 | Rodenchuk et al. |
| 4,245,692 | A | 1/1981 | Hargassner et al. |
| 4,270,593 | A | 6/1981 | Bachner |
| 4,505,321 | A | 3/1985 | Zeller |
| 4,523,623 | A | 6/1985 | Holleis et al. |
| 4,580,614 | A | 4/1986 | Haissig |
| 4,635,704 | A | 1/1987 | Chielens et al. |
| 4,669,526 | A | 6/1987 | Hury |
| 4,727,926 | A | 3/1988 | Tsutsumi et al. |
| 4,947,925 | A | 8/1990 | Wagstaff et al. |
| 5,279,354 | A | 1/1994 | Grove |
| 5,318,098 | A | 6/1994 | Wagstaff et al. |
| 5,518,063 | A | 5/1996 | Wagstaff et al. |
| 5,947,184 | A | 9/1999 | Steen et al. |
| 6,145,580 | A | 11/2000 | Lamberti et al. |
| 6,192,970 | B1 | 2/2001 | Tilak |
| 6,926,067 | B1 | 8/2005 | Horneschemeyer et al. |
| 8,561,669 | B2 | 10/2013 | Nasee, Jr. et al. |
| 9,630,244 | B2 | 4/2017 | Jarry et al. |
| 10,350,674 | B2 | 7/2019 | Cordill et al. |
| 2003/0160360 | A1 | 8/2003 | Naito |
| 2004/0055732 | A1 | 3/2004 | LeBlanc et al. |
| 2009/0000760 | A1 | 1/2009 | Kang et al. |
| 2012/0241118 | A1 | 9/2012 | Wagstaff et al. |

FOREIGN PATENT DOCUMENTS

| | | | |
|---|---|---|---|
| AR | 087025 | | 2/2014 |
| AR | 087026 | | 2/2014 |
| CN | 1857828 | A | 11/2006 |
| CN | 1925938 | A | 3/2007 |
| CN | 101835551 | | 9/2010 |
| CN | 102223967 | | 10/2011 |
| DE | 2923113 | | 12/1979 |
| DE | 4343124 | | 6/1995 |
| EP | 0492176 | | 11/1991 |
| FR | 2825038 | | 11/2002 |
| JP | S5026724 | | 3/1975 |
| JP | S 54-013422 | A | 1/1979 |
| JP | S 57-115946 | A | 7/1982 |
| JP | H 10500629 | | 1/1998 |
| JP | H 10-193043 | A | 7/1998 |
| JP | 2000-000639 | A | 1/2000 |
| JP | 3400355 | | 4/2003 |
| JP | 2016-022521 | A | 2/2016 |
| SU | 150727 | A2 | 9/1989 |
| WO | WO 2018/229634 | A1 | 12/2018 |

OTHER PUBLICATIONS

U.S. Appl. No. 16/621,125, filed Dec. 10, 2019, U.S. Pat. No. 11,331,715, Issued.

U.S. Appl. No. 15/619,866, filed Jun. 12, 2017, U.S. Pat. No. 10,350,674, Issued.

Office Action for Venezuela Patent Application No. VE 2019-0252 dated Jul. 27, 2022 (1 page).

International Search Report and Written Opinion for International Application No. PCT/IB2018/054214 dated Aug. 14, 2018.

Office Action for Russian Application No. 2019144046/05 dated May 13, 2020.

Office Action for Australian Application No. 2018283785 dated Aug. 31, 2020.

Office Action for Japanese Application No. 2019-569311 dated Nov. 24, 2020.

International Search Report and Written Opinion for PCT/US2023/062022 (ISA/EP) dated May 15, 2023 (17 pages).

Office Action for Bahrain Application No. 20190295 dated Feb. 27, 2023 w/English translation (12 pages).

2nd Office Action for China Application No. 201880039319.1 dated Sep. 16, 2021 (12 pages).

Office Action for Argentine Application No. P20180101598 dated Dec. 14, 2021 (5 pages).

* cited by examiner

DYNAMIC MOLD SHAPE CONTROL FOR DIRECT CHILL CASTING

CROSS-REFERENCE TO RELATED APPLICATIONS

This application is a continuation of U.S. patent application Ser. No. 16/621,125, filed on Dec. 10, 2019, issued as U.S. Pat. No. 11,331,715, which is a National Phase Entry of PCT Application No. PCT/IB2018/054214, filed on Jun. 11, 2018, which claims priority to U.S. patent application Ser. No. 15/619,866, filed on Jun. 12, 2017, issued as U.S. Pat. No. 10,350,674, the contents of each of which are hereby incorporated by reference in their entirety.

TECHNOLOGICAL FIELD

The present invention relates to a system, apparatus, and method for continuous casting of metal, and more particularly, to a mechanism for controlling the shape of a direct chill casting mold to dynamically control a profile of an ingot cast from the mold during the casting process.

BACKGROUND

Metal products may be formed in a variety of ways; however numerous forming methods first require an ingot, billet, or other cast part that can serve as the raw material from which a metal end product can be manufactured, such as through rolling or machining, for example. One method of manufacturing an ingot or billet is through a semi-continuous casting process known as direct chill casting, whereby a vertically oriented mold cavity is situated above a platform that translates vertically down a casting pit. A starting block may be situated on the platform and form a bottom of the mold cavity, at least initially, to begin the casting process. Molten metal is poured into the mold cavity whereupon the molten metal cools, typically using a cooling fluid. The platform with the starting block thereon may descend into the casting pit at a predefined speed to allow the metal exiting the mold cavity and descending with the starting block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein.

BRIEF SUMMARY

The present invention relates to a system, apparatus, and method for continuous casting of metal, and more particularly, to a mechanism for controlling the shape of a direct chill casting mold to dynamically control a profile of an ingot cast from the mold during the casting process. Embodiments may provide an apparatus for casting material including: first and second opposing side walls; first and second end walls extending between the first and second side walls, where the first and second opposing side walls and the first and second opposing end walls form a generally rectangular shaped mold cavity. At least one of the first and second opposing side walls may include two or more contact regions, where each of the two or more contact regions may be configured to be displaced relative to a straight line between a first end of the at least one of the first and second opposing side walls and a second end of the at least one first and second opposing side walls in response to receiving a respective force applied externally from the mold cavity. The respective displacement at a first of the two or more contact regions may be different from a displacement at a second of the two or more contact regions, and a respective force at each of the two or more contact regions may change the curvature of the at least one of the first and second opposing side walls.

According to some embodiments, the respective force at the first of the two or more contact regions may include a force in a first direction, where the respective force at the second of the two or more contact regions may include a force in a second direction, opposite the first direction. The respective force at the first of the two or more contact regions may include a force of a first magnitude in a first direction, where the respective force at the second of the two or more contact regions may include a force of a second magnitude in the first direction, the second magnitude being different from the first magnitude. The first and second opposing side walls may include an inner casting surface and an outer surface. Each of the first and second opposing side walls may further include a flexible bladder disposed along the outer surface, where a cooling fluid chamber is defined between each respective opposing side wall and the respective flexible bladder. The casting surface of each of the first and second opposing side walls may include a plurality of orifices in fluid communication with a respective fluid chamber. A baffle may be disposed between a cooling fluid chamber and the respective side wall, where the baffle includes a plurality of flow-restricting orifices. The plurality of orifices in each of the first and second opposing side walls may be configured to direct cooling fluid from the respective cooling fluid channel toward a cast material as the cast material advances past the casting surfaces of the first and second opposing side walls.

The first and second opposing side walls and the first and second opposing end walls of example embodiments may cooperate to define a mold cavity having a shape defined by the opposing side walls and end walls. Example embodiments of an apparatus may include: first means for applying a first force to a first of the two or more contact regions; and second means for applying a second force to a second of the two or more contact regions. The first means and the second means may be controlled by a single controller to change the shape of the mold cavity according to one or more properties of the material to be cast. The first means and second means may be configured to change the shape of the mold cavity as the material is cast based on one or more of a cast material alloy, a temperature of the cast material exiting the mold cavity, a temperature profile of the cast material, or a shape of the cast material exiting the mold cavity.

Embodiments of an apparatus provided herein may include a controller, where the displacement of the first contact region and the displacement of the second contact region are performed in response to at least one of an unexpected slowing of liquid into the mold cavity or feedback from an actuator applying a respective force to one or both of the first contact region and the second contact region. Embodiments may include two or more fixed position members, where the two or more fixed position members may be configured to resist movement of the first and second opposing side walls in response to a respective force applied at one or more of the two or more contact regions. The first and second opposing side walls may each include an upper portion and a lower portion. The upper portion of the at least one of the first and second opposing side walls may be displaced proximate the first contact region a first distance relative to the straight line between the first end of the at least one of the first and second opposing side walls and the second end of the at least one first and second opposing side walls. The lower portion of the at least one of the first and second opposing side walls may be displaced proximate the first contact region a second distance relative to the straight line between the first end of the at least one of the first and second opposing side walls and the second end of the at least one first and second opposing sidewalls, thereby defining a taper between an upper portion of the mold cavity and a lower portion of the mold cavity.

Embodiments described herein may provide a system for casting metal. The system may include: a controller; a mold including a first side wall, a second side wall opposite the first side wall, a first end wall, and a second end wall opposing the first end wall. The first side wall, second side wall, first end wall, and second end wall may cooperate to define a mold cavity having a mold cavity profile. The system may include a first force receiving element of the first side wall located opposite the mold cavity, where a first force applied to the first force receiving element may be controlled by the controller and cause a first displacement of the first side wall at the first force receiving element. A second force receiving element of the first side wall may be located opposite the mold cavity, where a second force applied to the second force receiving element may be controlled by the controller and causes a displacement of the first side wall at the second force receiving element. The first displacement may be different than the second displacement. The controller may be configured to adjust the first displacement of the first force receiving element and the second displacement of the second force receiving element during a casting process using the mold. The controller may adjust the first displacement and the second displacement in response to at least one of a property of the metal being cast or a profile of the metal exiting the mold.

According to some embodiments, the first side wall and the second side wall of the mold may each include a plurality of orifices for directing cooling fluid along metal exiting the mold during the casting process. A cooling fluid channel may be defined along the first side wall outside of the mold cavity, where the cooling fluid channel may be defined between the first side wall and a flexible bladder. The first force and the second force may be configured to be applied to the first force receiving element and the second force receiving element in opposite directions. Each of the first side wall and the second side wall may define therein a respective cooling fluid channel and a plurality of cooling fluid orifices. The system may include a cooling fluid supply, where the cooling fluid supply may be configured to provide cooling fluid to each of the respective cooling fluid channels to be sprayed through the plurality of orifices toward a cast material exiting the mold cavity at different angles.

Embodiments described herein may provide a component of a mold. The component may have a body extending along a length defined between a first end wall and a second end wall; an inner face defining a portion of a mold cavity and extending from the first end wall to the second end wall; and an outer surface opposite the inner face, where the outer surface is configured to receive a first force and a second force. The first end wall and the second end wall may be substantially stationary, where the component is configured to be displaced from a first shape between the first end wall and the second end wall to a second shape between the first end wall and the second end wall in response to application of the first force and the second force, where the first force and the second force are different.

Embodiments may provide a wall of a direct chill casting mold that includes: a longitudinally extending body extending along a length between a first end and a second end; an inner face defining a portion of a mold cavity and extending from proximate the first end to proximate the second end, where a first set of orifices and a second set of orifices are defined in the wall proximate the inner face; an outer face opposite the inner face; a first fluid chamber disposed proximate the outer surface; and a second fluid chamber disposed proximate the outer surface, wherein the first fluid chamber is in fluid communication with the first set of orifices and the second fluid chamber is in fluid communication with the second set of orifices. According to some embodiments, the inner face may be configured to be displaced along an axis substantially orthogonal to the inner face in response to receiving a force along the axis applied to the outer surface. The first set of orifices may include a set of orifices arranged proximate the inner face of the longitudinally extending body and the first set of orifices may extend along the longitudinally extending body. The second set of orifices may include a set of orifices arranged proximate the inner face of the longitudinally extending body and the second set of orifices may extend along the longitudinally extending body.

According to some embodiments, the wall of the direct chill casting mold may include a first set of fasteners, a second set of fasteners, and a third set of fasteners, where each of the first, second, and third set of fasteners extend longitudinally along the outer surface. The first fluid chamber may be disposed between the first set of fasteners and the second set of fasteners, and the second fluid chamber may be disposed between the second set of fasteners and the third set of fasteners. The first fluid chamber and the second fluid chamber may extend along the longitudinally extending body on the outer surface, where the outer surface of the side wall defines at least one wall of the first fluid chamber and the second fluid chamber. The first fluid chamber and the second fluid chamber may be bounded on one side by the outer surface of the side wall and bounded opposite the outer surface of the side wall by a flexible membrane.

The wall of a direct chill casting mold of example embodiments may include a force receiving member, where the force receiving member may be attached to the outer surface of the longitudinally extending body and is attached to the outer surface of the longitudinally extending body by a first subset of at least two of the first set of fasteners, the second set of fasteners, and the third set of fasteners. The force receiving member may be repositionable along the longitudinally extending sets of fasteners using a second subset of at least two of the first set of fasteners, the second set of fasteners, and the third set of fasteners, where the second subset is different from the first subset. The first fluid chamber may be in fluid communication with the first set of orifices through a passage defined within the side wall. The inner face of the side wall may include a graphite material, where the graphite material may be configured to flex in congruence with the wall of the direct chill casting mold.

BRIEF DESCRIPTION OF THE DRAWINGS

Figure 1:
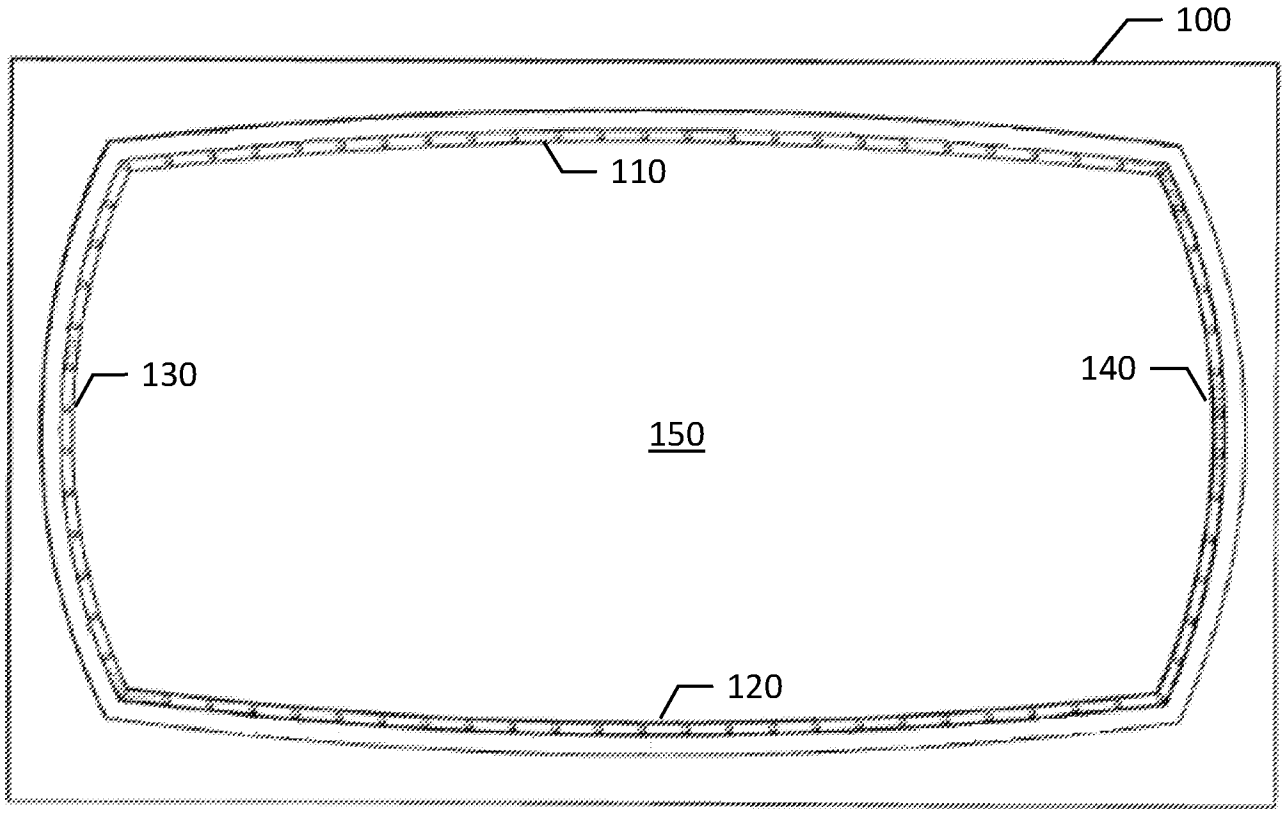
PRIOR ART FIG. 1
Figure 2:
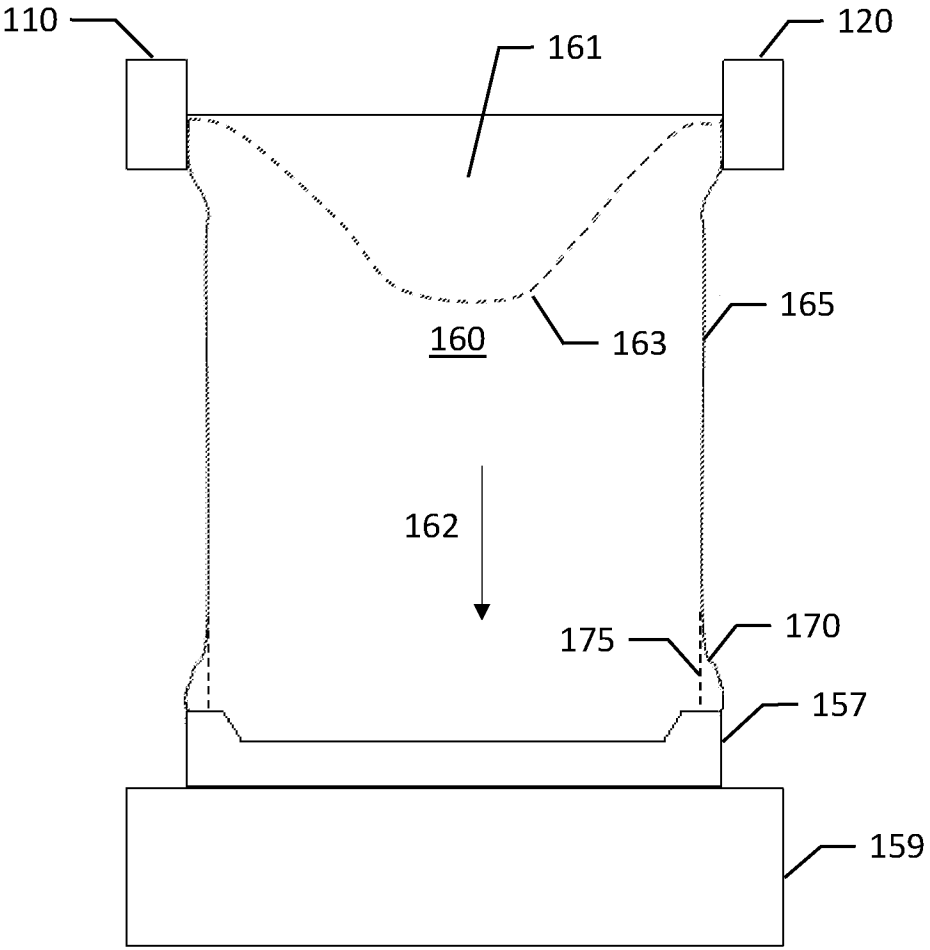
PRIOR ART FIG. 2
Figure 3:
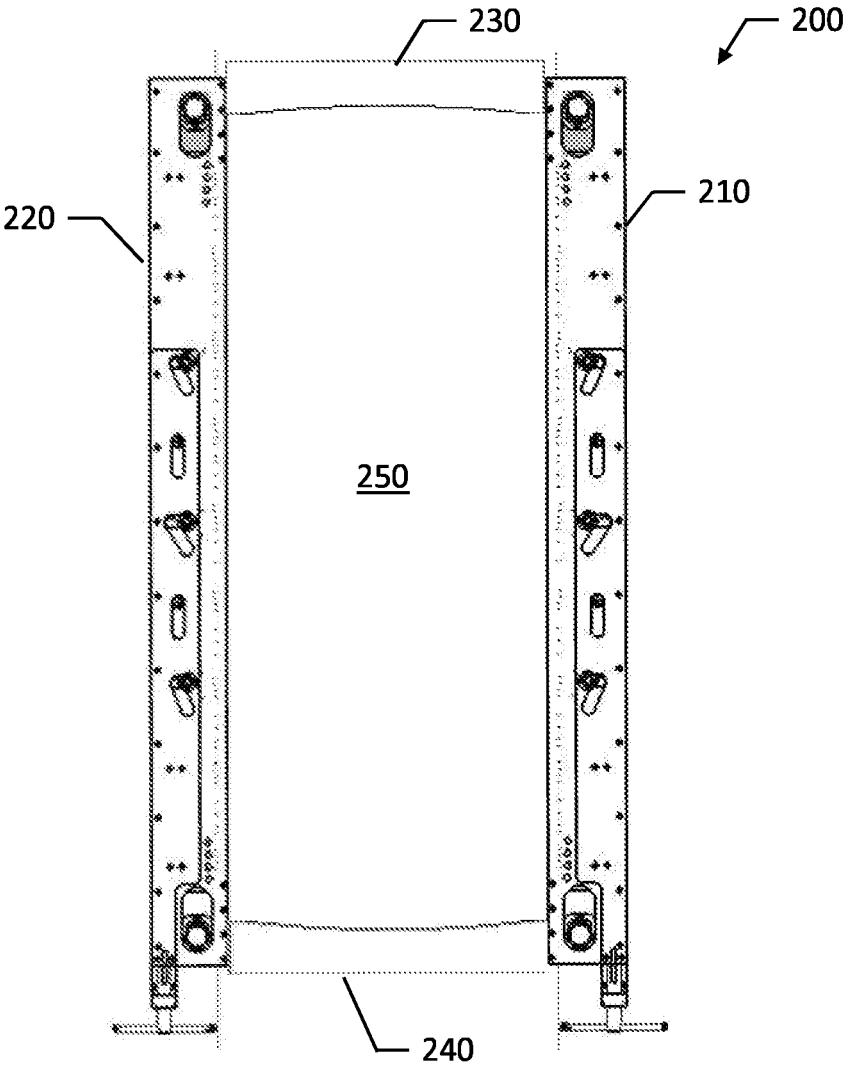
Figure 4:
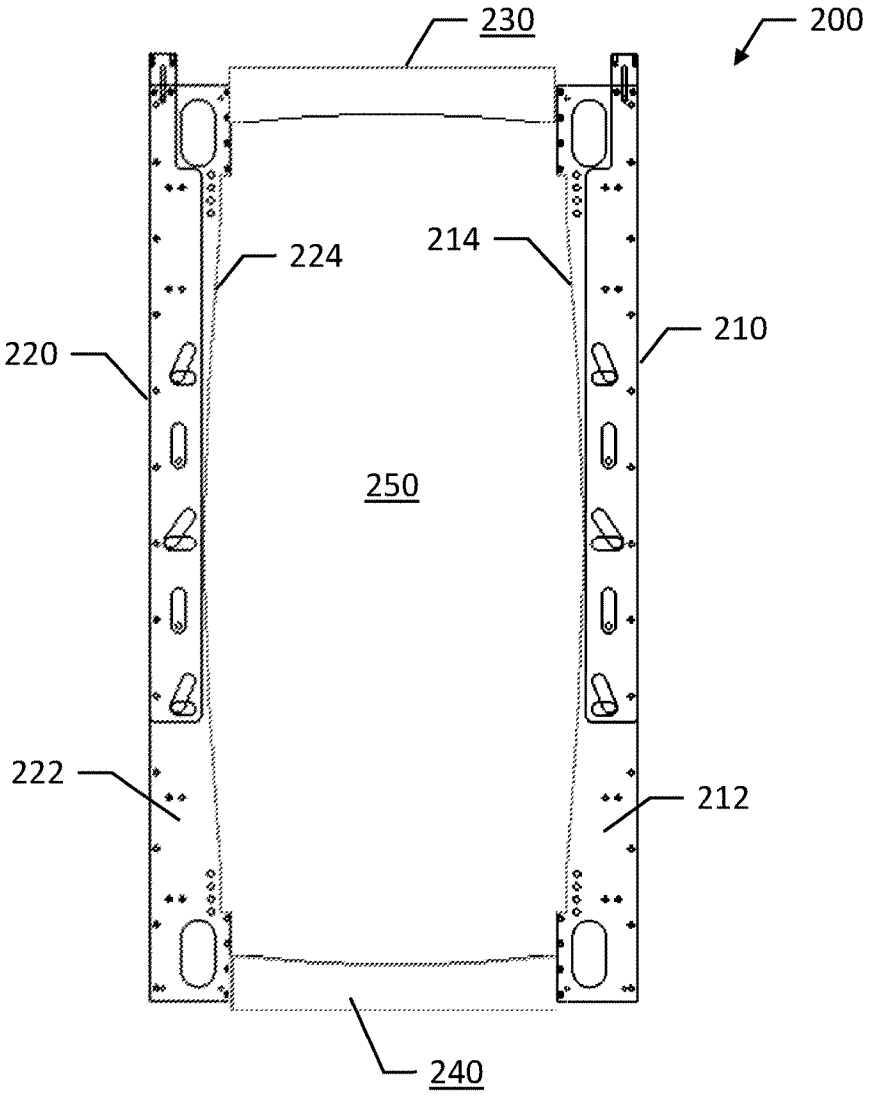
Figure 5:
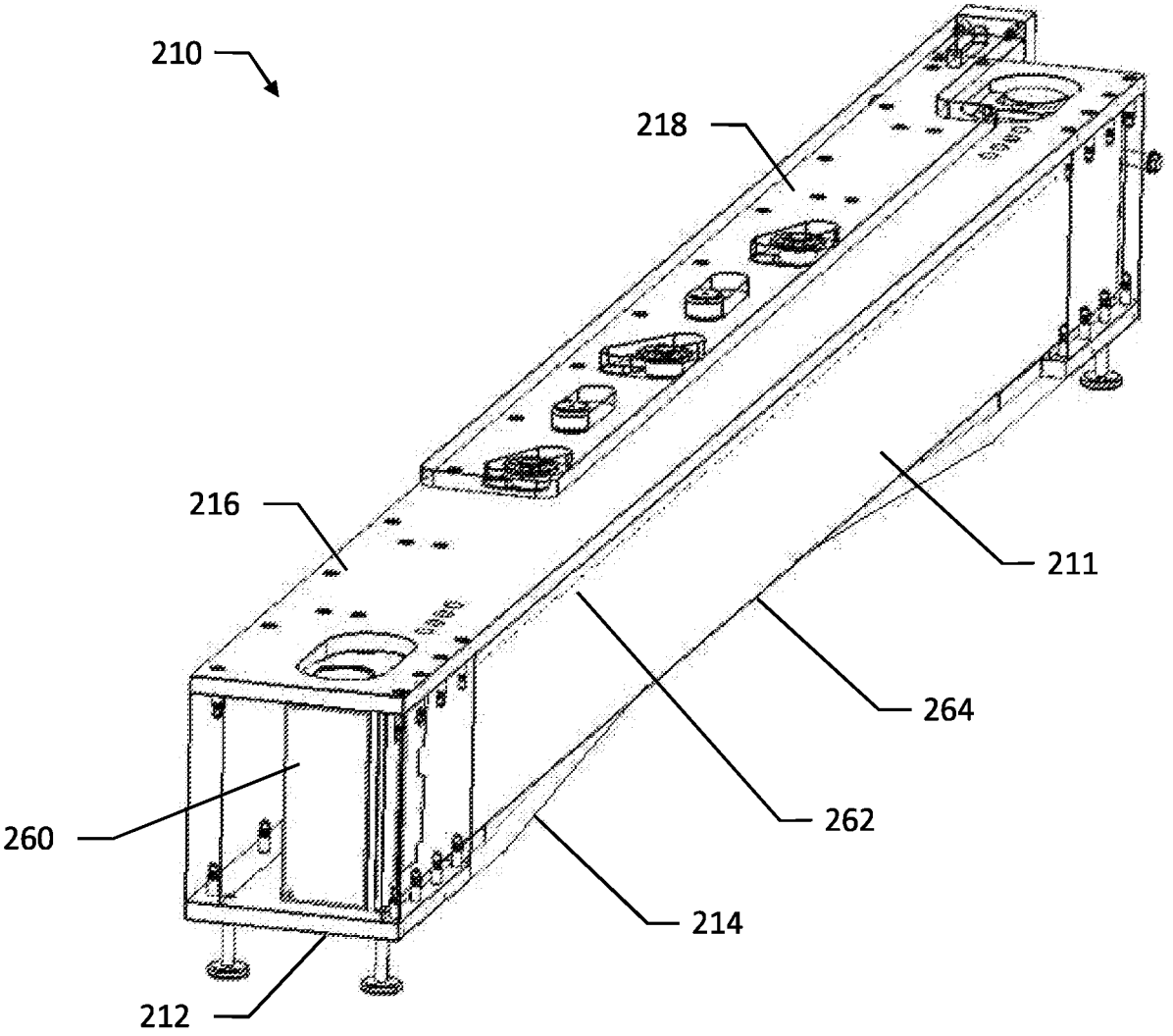
Figure 6:
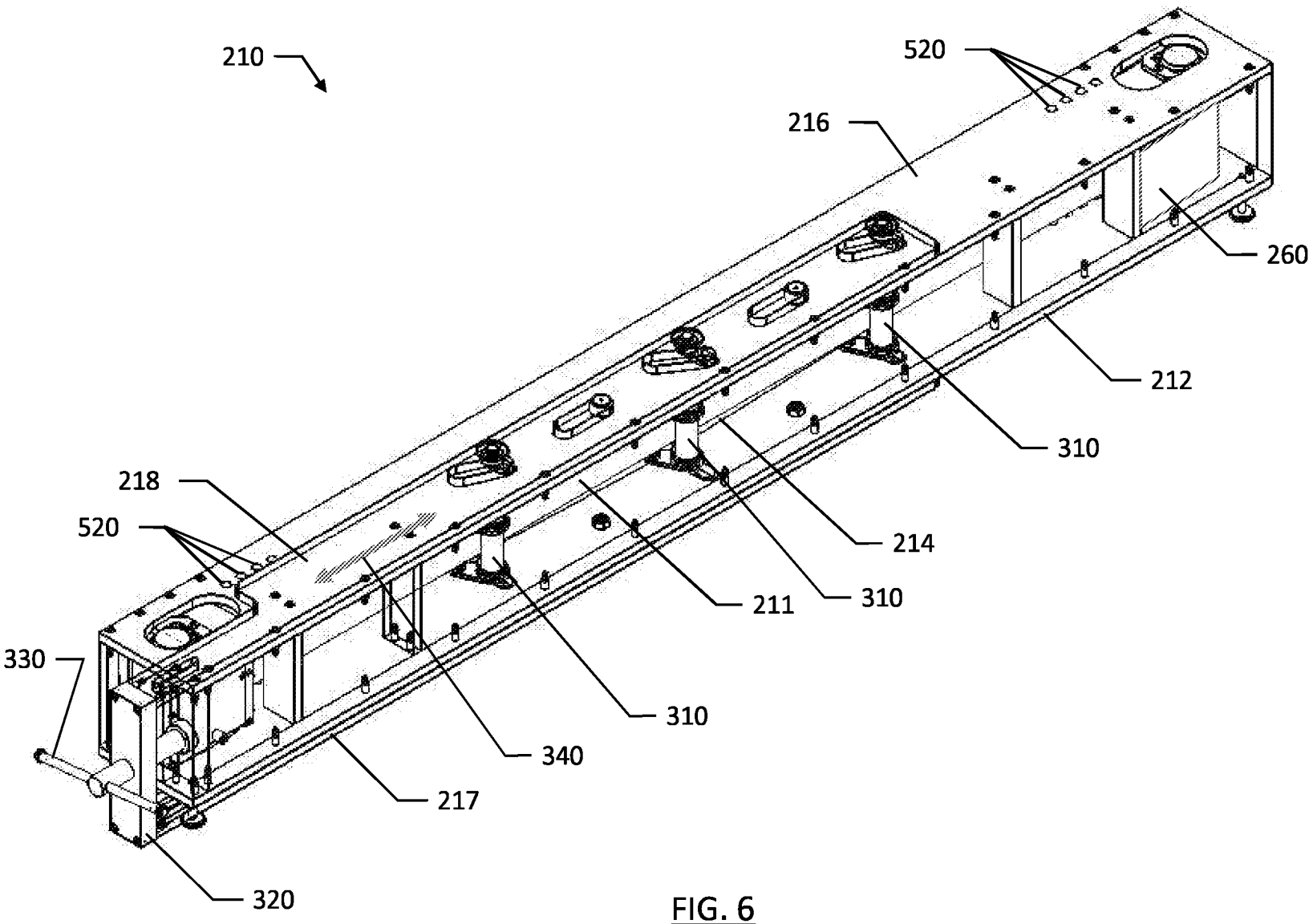
Figure 7:
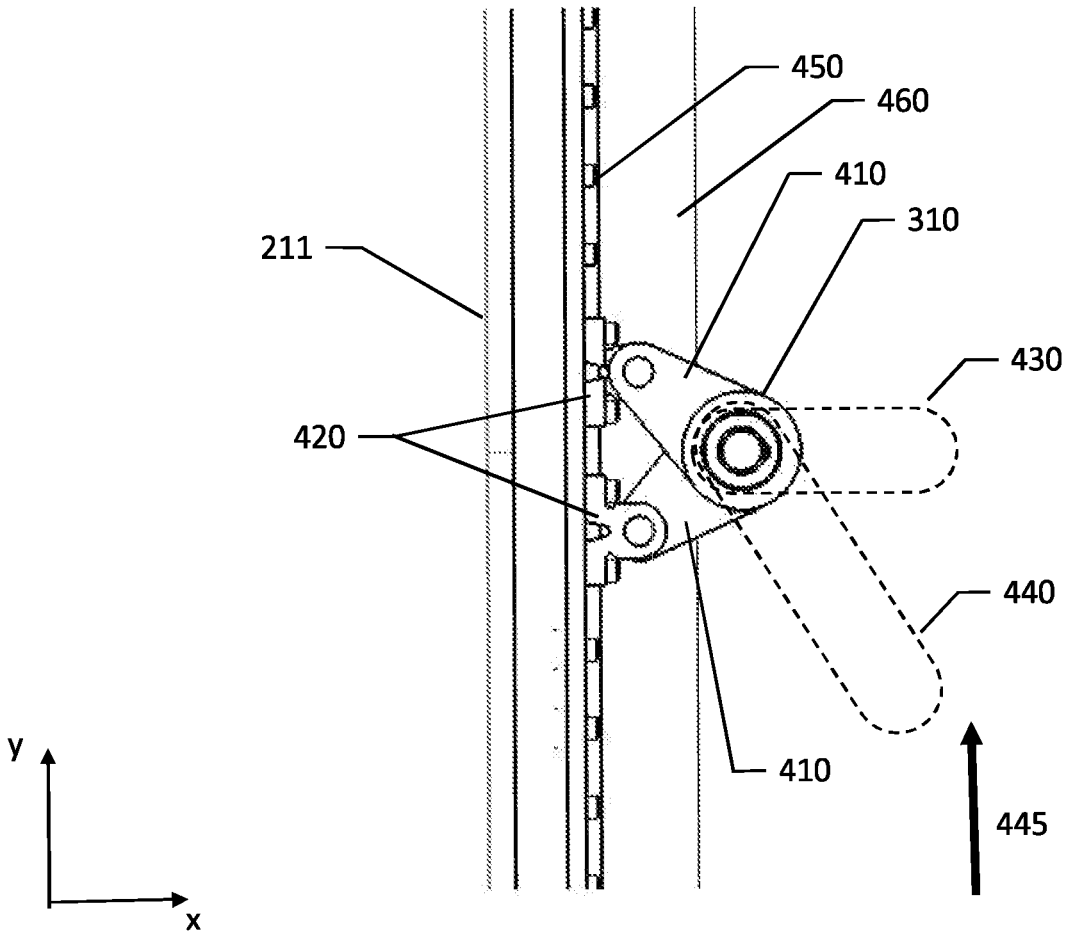
Figure 8:
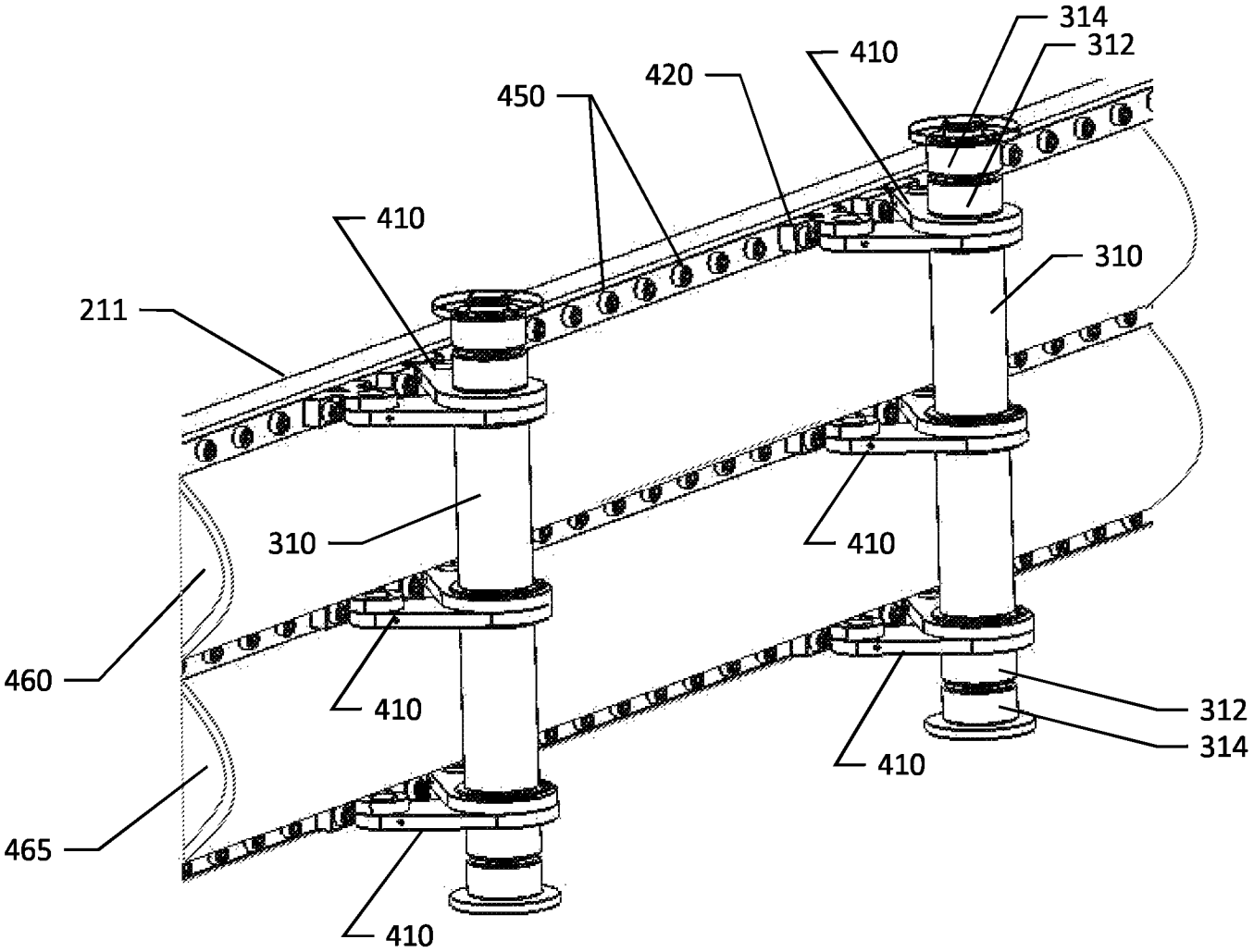
Figure 9:
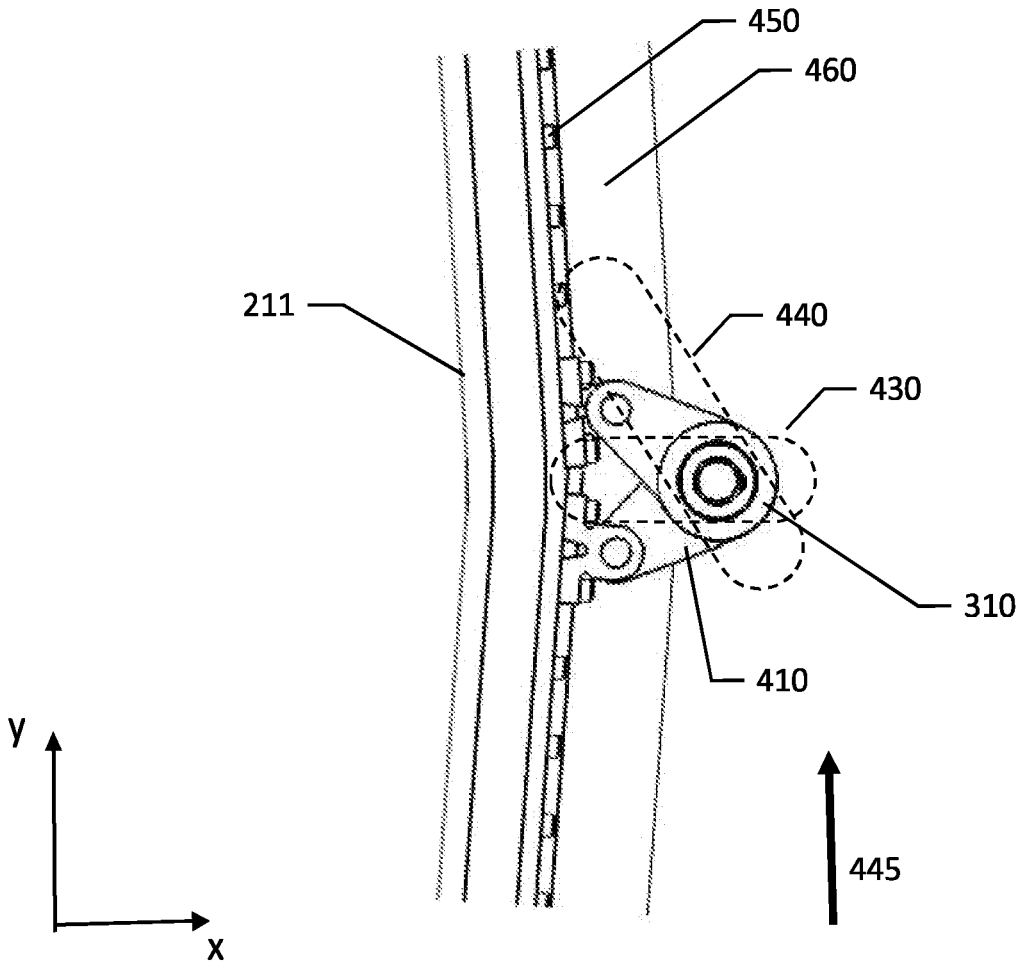
Figure 10:
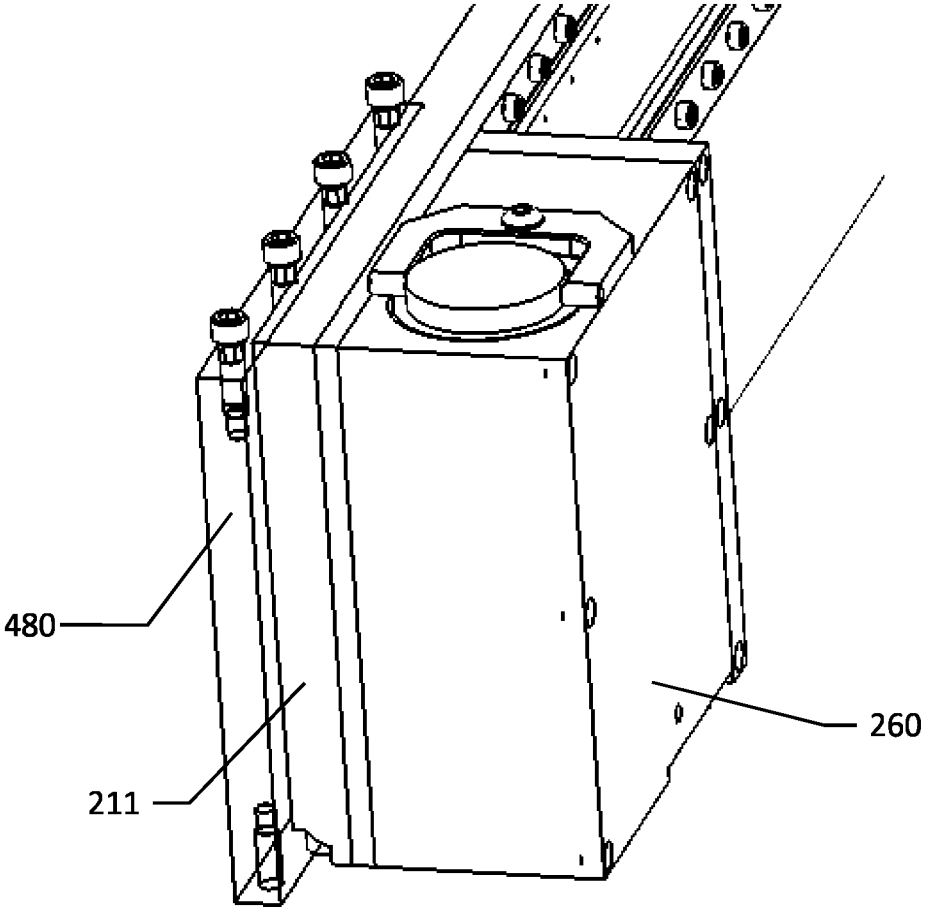
Figure 11:
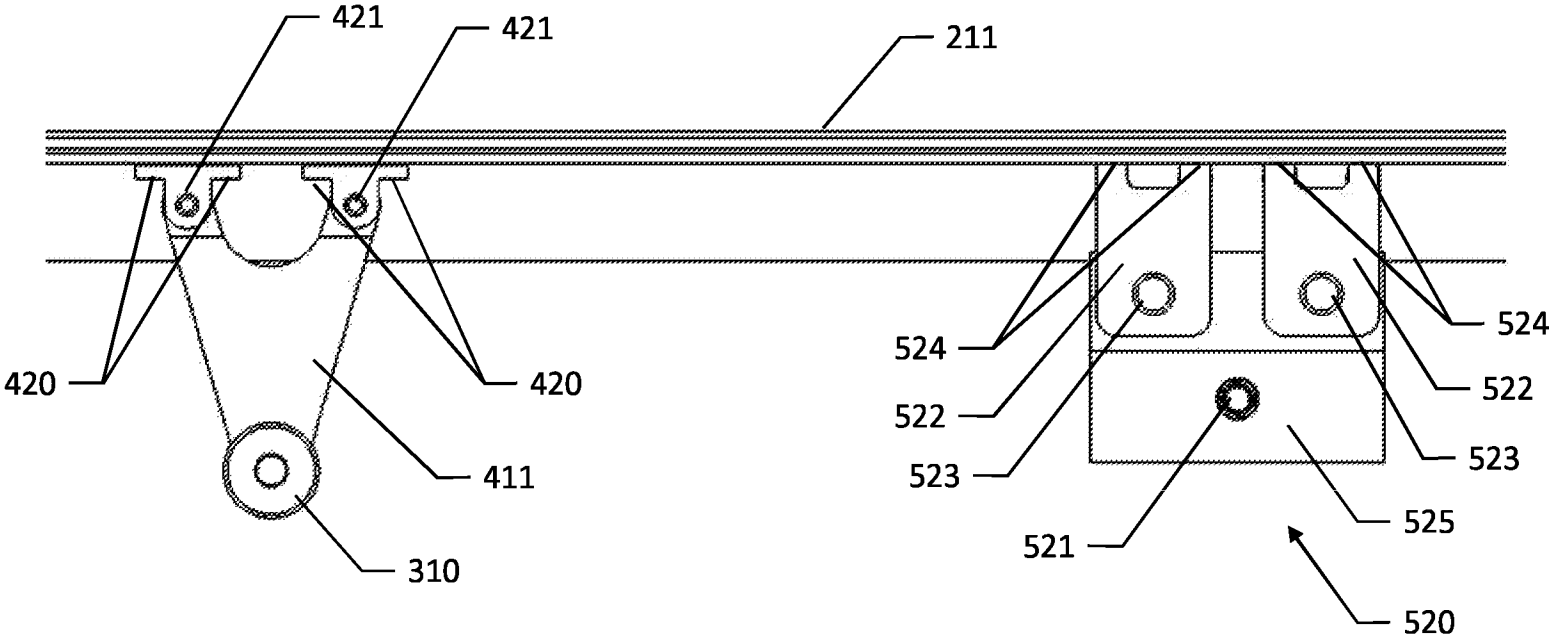
Figure 12:
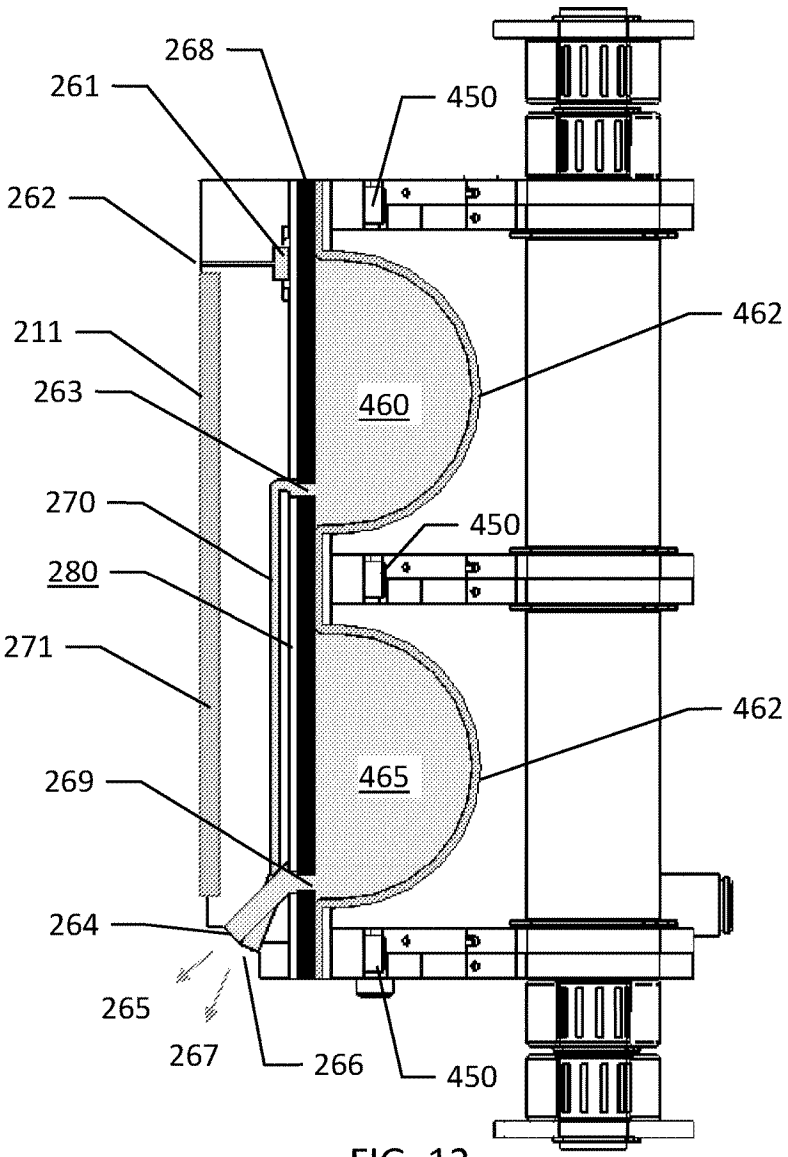
Figure 13:
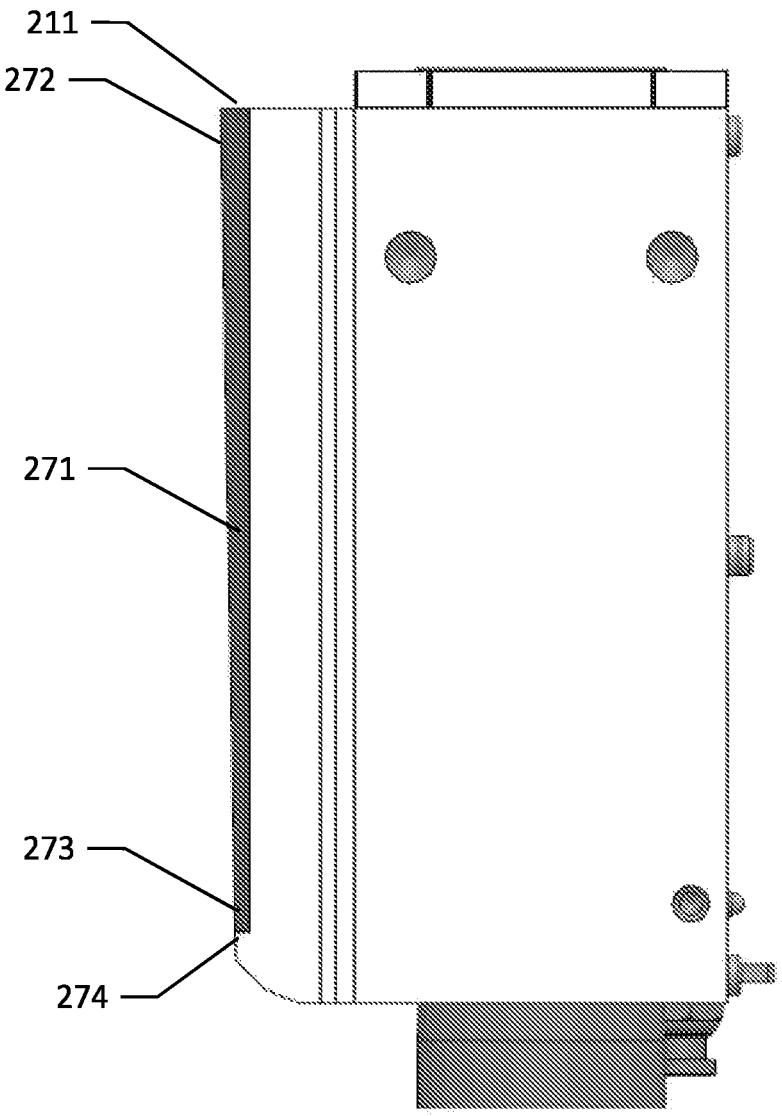
Figure 14:
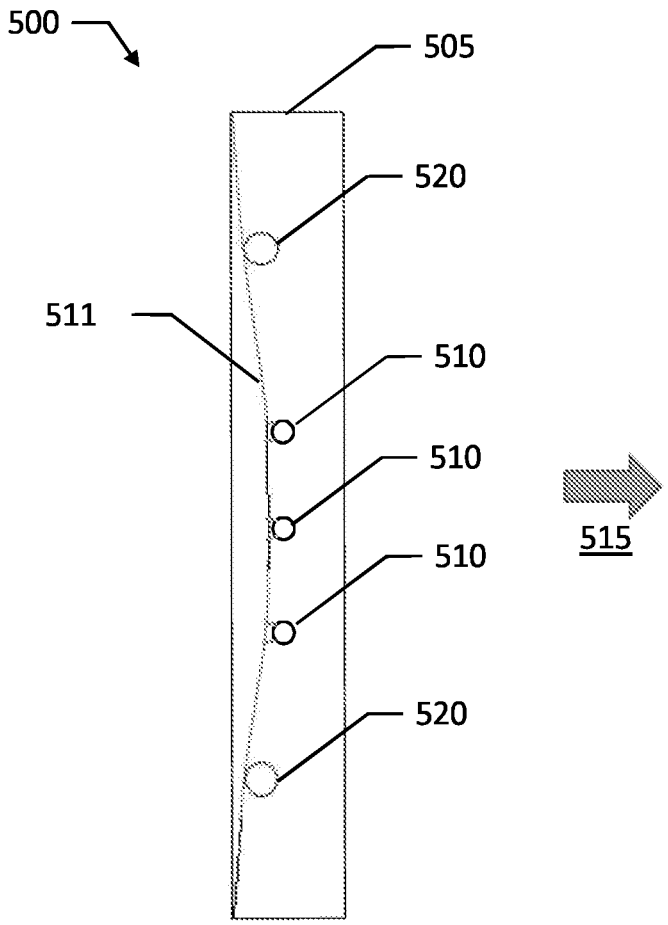
Figure 15:
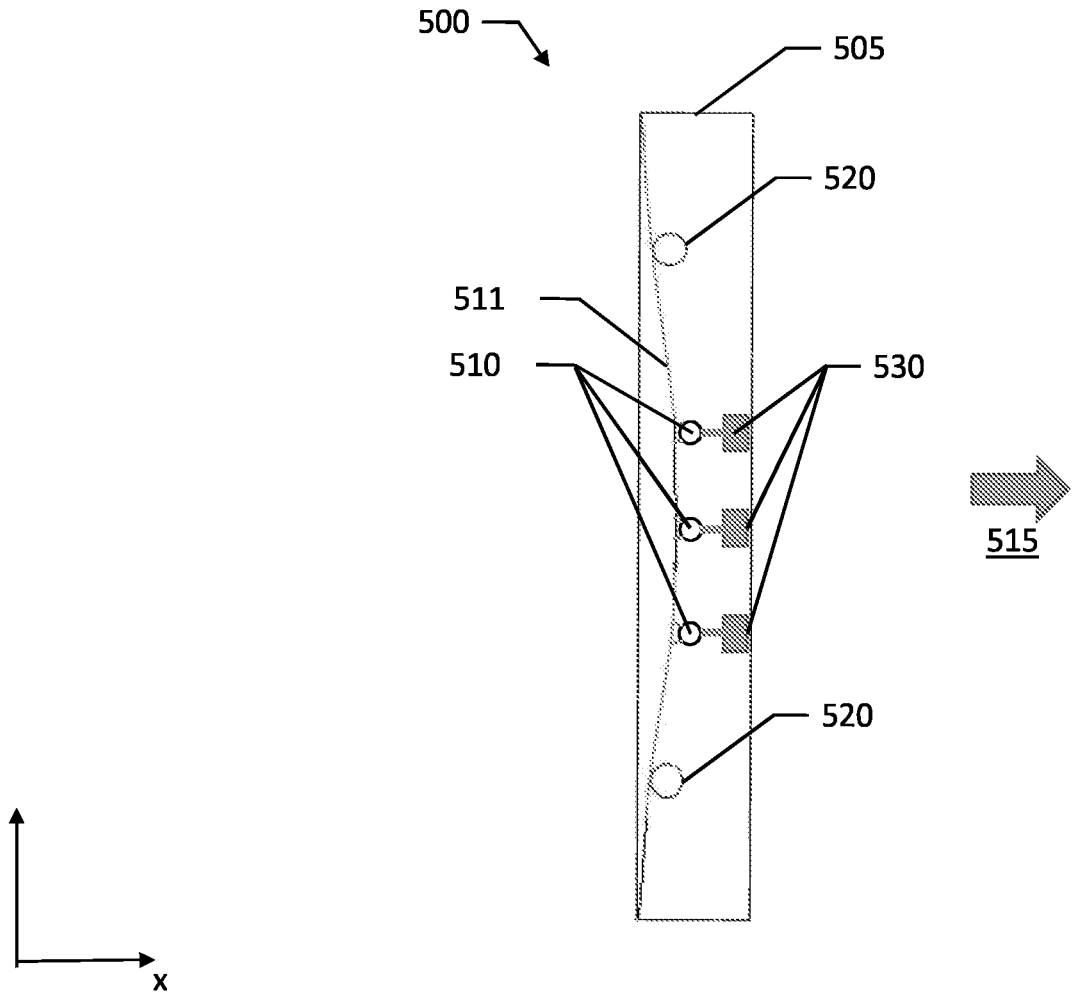
Figure 16:
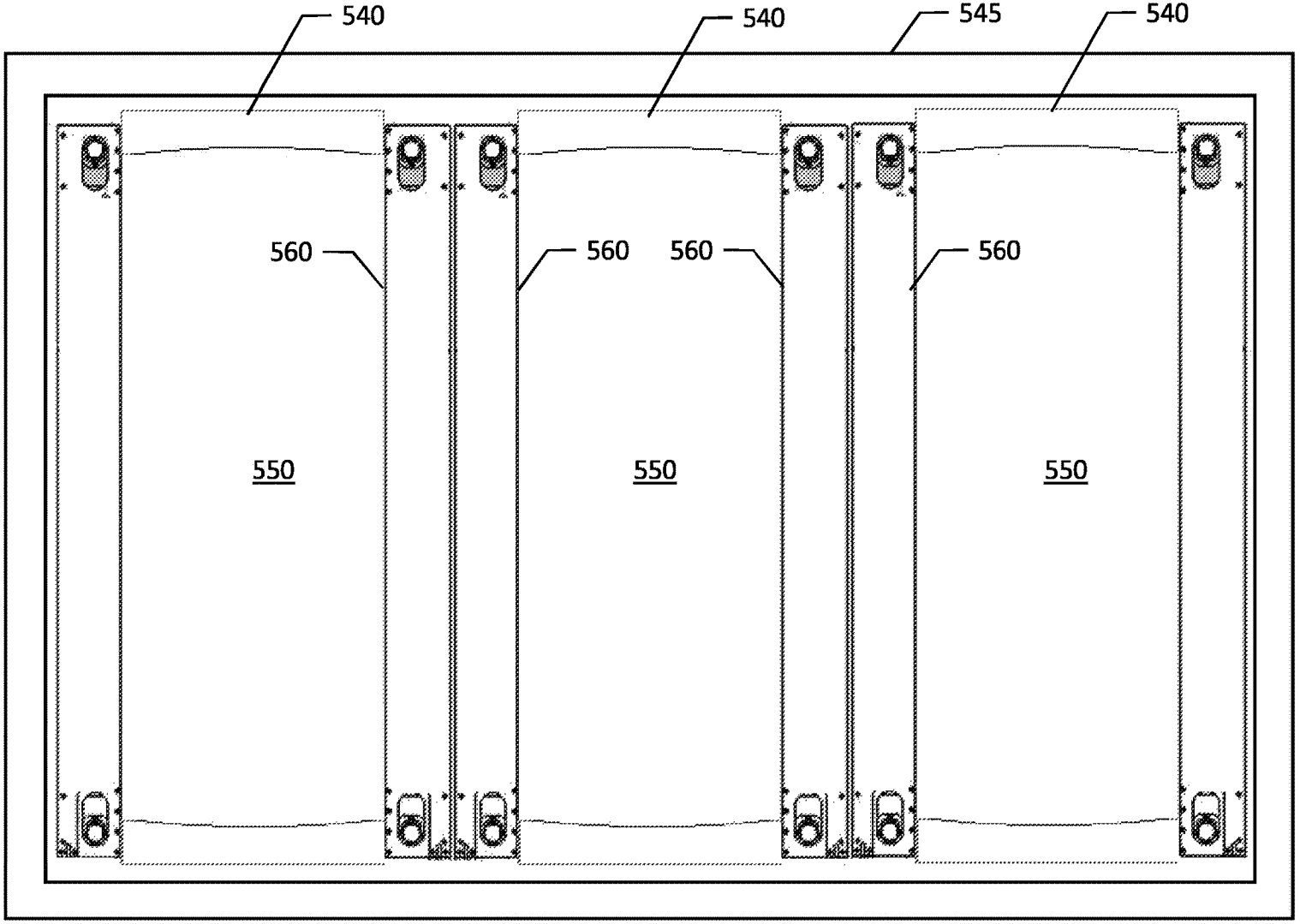
Figure 17:
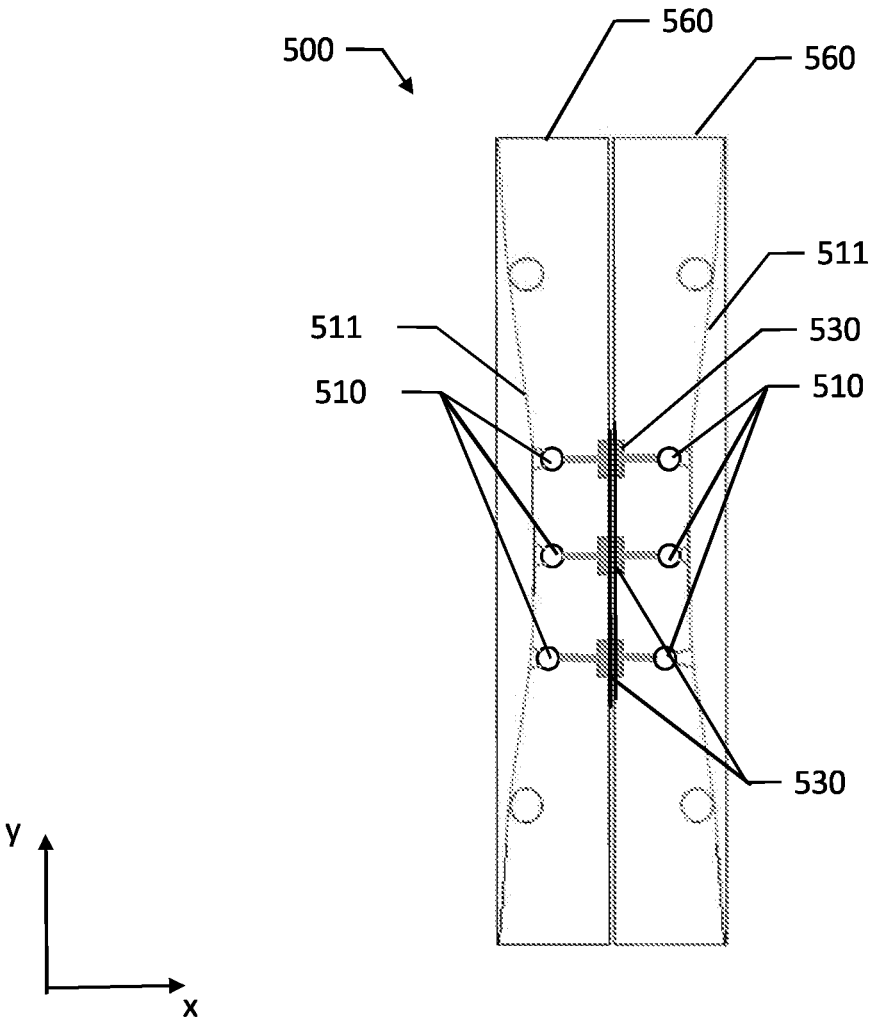

Having thus described the invention in general terms, reference will now be made to the accompanying drawings, which are not necessarily drawn to scale, and wherein:

FIG. 1 illustrates an example embodiment of a direct chill casting mold according to the prior art;

FIG. 2 illustrates an ingot formed through direct chill casting according to the prior art;

FIG. 3 illustrates a top view of a direct chill casting mold having sides with an adjustable curvature profile according to an example embodiment of the present invention;

FIG. 4 illustrates a bottom view of a direct chill casting mold having sides with an adjustable curvature profile according to an example embodiment of the present invention;

FIG. 5 depicts a side wall assembly of a direct chill casting mold according to an example embodiment of the present invention;

FIG. 6 depicts another view of a side wall assembly of a direct chill casting mold according to an example embodiment of the present invention;

FIG. 7 illustrates a component view of a side wall and force receiving member of a side wall assembly of a direct chill casting mold in a straight configuration according to an example embodiment of the present invention;

FIG. 8 illustrates a view of the rear face of a portion of a side wall assembly of a direct chill casting mold according to an example embodiment of the present invention;

FIG. 9 illustrates the component view of a side wall and a force receiving member of a side wall assembly of a direct chill casting mold in a curved configuration according to an example embodiment of the present invention;

FIG. 10 depicts an end of a portion of a side wall assembly of a direct chill mold according to an example embodiment of the present invention;

FIG. 11 illustrates a mechanism for force distribution along a side wall of a side wall assembly of a direct chill mold according to an example embodiment of the present invention;

FIG. 12 illustrates a cut-away view of a side wall of a direct chill mold according to an example embodiment of the present invention;

FIG. 13 illustrates a profile view of a mold wall of a direct chill mold including an inner casting surface according to an example embodiment of the present invention;

FIG. 14 illustrates a top view of a direct chill mold having adjustable side walls according to an example embodiment of the present invention;

FIG. 15 illustrates a top view of a direct chill mold having adjustable side walls according to another example embodiment of the present invention;

FIG. 16 depicts a mold frame assembly including a plurality of direct chill molds according to an example embodiment of the present invention; and FIG. 17 illustrates two adjacent side wall assemblies of adjacent direct chill mold assemblies according to an example embodiment of the present invention.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Embodiments of the present invention generally relate to the design of a direct chill casting mold to facilitate a more consistent ingot profile. Vertical direct chill casting is a process used to produce ingots or billets that may have large cross sections for use in a variety of manufacturing applications. The process of vertical direct chill casting begins with a horizontal table containing one or more vertically-oriented mold cavities disposed therein. Each of the mold cavities is initially closed at the bottom with a starting block or starting plug to seal the bottom of the mold cavity. Molten metal is introduced to each mold cavity through a metal distribution system to fill the mold cavities. As the molten metal proximate the bottom of the mold, adjacent to the starting block solidifies, the starting block is moved vertically downward along a linear path. The movement of the starting block may be caused by a hydraulically-lowered platform to which the starting block is attached. The movement of the starting block vertically downward draws the solidified metal from the mold cavity while additional molten metal is introduced into the mold cavities. Once started, this process moves at a relatively steady-state for a semi-continuous casting process that forms a metal ingot having a profile defined by the mold cavity, and a height defined by the depth to which the platform and starting block are moved.

During the casting process, the mold itself is cooled to encourage solidification of the metal prior to the metal exiting the mold cavity as the starting block is advanced downwardly, and a cooling fluid is introduced to the surface of the metal proximate the exit of the mold cavity as the metal is cast to draw heat from the cast metal ingot and to solidify the molten metal within the now-solidified shell of the ingot. As the starting block is advanced downward, the cooling fluid may be sprayed directly on the ingot to cool the surface and to draw heat from within the core of the ingot.

The direct chill casting process enables ingots to be cast of a wide variety of sizes and lengths, along with varying profile shapes. While circular billet and rectangular ingot are most common, other profile shapes are possible. Circular profile billets benefit from a uniform shape, where the distance from the external surface around the billet to the core is equivalent around the perimeter. However, rectangular ingots lack this uniformity of surface-to-core depth and thus have additional challenges to consider during the direct chill casting process.

A direct chill casting mold to produce an ingot with a rectangular profile does not have a perfectly rectangular mold cavity due to the deformation of the ingot as it cools after leaving the mold cavity. The portion of the ingot exiting the mold cavity as the platform and the starting block descend retains a molten or at least partially molten core inside the solidified shell. As the core cools and solidifies, the external profile of the ingot changes such that the mold cavity profile, while it defines the shape of the final, cooled ingot, does not have a shape or profile that is identical to the final, cooled ingot.

FIG. 1 is an example embodiment of a conventional direct chill casting mold 100 which would be received within a table or frame assembly of a direct chill casting system. As shown, the mold 100 includes first 110 and second 120 opposing side walls extending between first 130 and second 140 end walls of the mold cavity. The first and second opposing side walls 110, 120 and the first and second end walls 130, 140, combine to form the mold cavity 150 having a generally rectangular profile. The first and second opposing side walls 110, 120, have an arcuate shape, or at least some degree of curvature to the wall profile. This shape enables the cast ingot to have substantially flat opposing sides during a steady-state casting operation of the direct chill casting process. The end walls 130 and 140 may also have a specified shape, which may include a curvature, a series of flat sides arranged in an arcuate shape, a compound curvature, or a straight side, for example. The "steady-state"

portion of the casting process, as described herein, is the portion of the casting process after the initial start-up phase or start up casting phase and before the end of the casting process or ending casting phase. Steady-state casting occurs when the temperature profile in the portion of the ingot exiting the mold cavity remains constant or near constant. Different casting control parameters may be desired at each phase of the casting from starting phase to steady-state phase to ending phase based on the type of material being cast.

While direct chill casting molds have been designed and developed to generate an ingot having substantially flat sides on its rectangular profile for the ingot portion produced during a steady-state portion of the casting process, the start-up process of direct chill casting includes challenges that distinguish the start-up casting phase process and the initial portion of the ingot formed during the start-up casting phase process from the steady-state phase of the casting process and the portion of the ingot formed during steady-state casting.

During the start-up phase of direct chill casting, high thermal gradients induce thermal stresses that cause deformation of the ingot in manners that are distinct from those experienced during the steady-state phase of casting. Due to the changes in thermal gradients and stresses experienced in the start-up phase versus the steady-state phase of casting, a constant-profile mold cavity results in a non-uniform profile of the ingot portion cast during the start-up phase, also known as the butt, and the ingot cast during the steady-state casting phase. As the portion produced during steady-state casting forms the majority of the ingot, the mold profile may be designed such that the opposed sides and ends of an ingot are substantially flat. This may result in a butt of the ingot formed during the start-up phase lacking substantially flat sides, as illustrated in the cast ingot cross-section of FIG. 2. The illustrated embodiment of FIG. 2 depicts a basic cross-section of an ingot mold during the casting process. As illustrated, the molten metal 161 is received within the cavity of the mold, between mold side walls 110 and 120, where the molten metal transitions to solid metal proximate the sump indicated by dashed line 163. The starting block 157 of the illustrated position has already descended with the platform 159 in the direction of arrow 162, and the casting is presently in the steady-state phase, with the sides 165 of the ingot 160 being substantially flat. The portion of the ingot 160 produced during the start-up phase is shown adjacent to the starting block 157 with a profile that is swollen 170 with respect to the desirable flat sides 175 of the steady-state casting phase.

The deformation 170 of the ingot portion produced during the start-up phase may not be usable depending upon the end-use of the ingot, such that the portion of the ingot formed during the start-up period may be sacrificial (i.e., cut from the ingot and repurposed/re-cast). This sacrificial butt portion of the ingot may be substantial in size, particularly in direct chill casting molds that have relatively large profiles, and while the butt may be re-cast so the material is not lost, the lost time, reheating/re-melting costs and labor associated with the lost portion of the ingot, and the reduced maximum size potential of an ingot result in losses in efficiency of the direct chill casting process. Similar issues may exist at the end of a casting in forming the "head" of the ingot or billet, where casting ceases to be steady-state and may require specific control parameters to maximize the useable portion of the ingot and reducing waste.

Certain embodiments of the present invention include a direct chill casting mold that has flexible opposing side walls that may be dynamically moved during the casting process to eliminate the butt swell of conventional direct chill ingot casting molds to reduce waste and to improve the efficiency with which ingots are cast. Direct chill casting molds as described herein may include an opposed pair of casting surfaces on side walls of the mold that are flexible allowing them to change shape while the mold is casting an ingot. Each of the opposed side walls may include two or more contact portions or force receiving elements, each configured to receive a force that causes the opposed side walls of the mold to move dynamically and change shape during the casting process. The forces applied to the two or more contact regions may be independent and may include forces in opposing directions, as described further below. The contact regions may optionally be repositionable along the length of the opposing side walls to enable greater control over the shape of the side wall resulting from the forces applied.

FIG. 3 illustrates a top-view of a direct chill casting mold assembly 200 according to an example embodiment of the present invention. As shown, the mold assembly 200 includes first and second opposing side wall assemblies 210, 220, and first and second end wall assemblies 230, 240. Each of the opposing side wall assemblies 210, 220 include a side wall of the mold cavity 250 that cooperate with end walls of end wall assemblies 230 and 240 to form the profile of the mold cavity which is the shape of the perimeter of the mold cavity.

FIG. 4 illustrates a view of the bottom plates of the mold assembly 200, omitting the side wall assemblies and top plates of the mold assembly visible in FIG. 3 for ease of understanding. As shown, the bottom plates 212 and 222 of the opposing side wall assemblies 210 and 220 include a curvature 214 and 224 in the edge facing the mold cavity 250. This curvature provides an opening at the bottom of the mold assembly 200 that is at least as large as the side walls and end walls of the mold cavity 250 may provide. While the side walls of the mold assembly 200 may define a curvature that is less than that of the respective bottom plate 212, 222, the curvature of the respective side walls may not be greater than the curvature 214, 224 of the bottom plates 212, 222 of the side wall assemblies 210, 220.

As noted above, the opposing side walls of example embodiments described herein may include a profile that is dynamically adjustable from between two or more curvature profiles. The adjustment of the opposing side wall curvature may enable an ingot butt or billet butt produced at the start-up of the casting process to be produced without swelling or other dimensional or physical attributes that render the butt unsatisfactory for the intended purpose of the billet or ingot being cast. Example embodiments described herein allow near infinite size optimization from one mold in a given casting pit.

FIG. 5 illustrates one of the pair of opposing side wall assemblies 210 including a top plate 216, an actuation plate 218, and a bottom plate 212. The bottom plate includes curvature 214 as described above with respect to FIG. 4. The side wall 211 is illustrated in a substantially straight, un-bent configuration. Also visible is fluid conduit block 260 configured to allow cooling fluid to flow through channels disposed behind the side wall 211, as described and illustrated below. The side wall may include a taper from the top to the bottom, narrowing the opening 250. While any degree of taper may be used, a desirable range may be on the order of one half of a degree of taper to three degrees of taper from the top edge of the side wall 211 to the bottom edge of the side wall. The fluid conduit block 260 may include a fluid flow path to adapt the fluid flow from an inlet of the fluid conduit block to one or more fluid chambers of the side wall assembly 210. The fluid conduit block 260 may optionally include one or more valves to control the flow of fluid through the fluid conduit block 260 to the one or more fluid chambers of the side wall assembly 210. The fluid conduit block 260 may optionally include one or more filter elements to filter fluid as it passes through the fluid conduit block. Further, the fluid conduit block 260 may optionally regulate pressure of the cooling fluid.

The side wall 211 of example embodiments may be made of a material that is strong, but flexible to facilitate bending of the mold wall as described in greater detail below. For example, aluminum may be used, and in particular, 6061-T651 may be selected due to the strength-to-flexibility ratio and corrosion resistance. Aluminum with a T651 treatment is solution heat treated, stress-relieved, and artificially aged which enhances properties desirable in embodiments of the present application. Casting of molten aluminum may influence the metal composition, though embodiments described herein may lose temper only in the surface of the mold walls as the cooling mechanisms described below will help maintain a lower temperature in the mold walls and thus the temper and strength of the material used for the mold walls will be more consistently maintained. A-O temper (annealed) may be used due to the distance from the casting surface to the water chamber being low such that the temperature gradient across the mold wall material may be high.

Cooling fluid pressure within the fluid chambers discussed further below may be in a range about 0 psi (pounds per square inch) to about 45 psi, and desirably between about 2 psi and 15 psi. On the face of side wall 211 there are a plurality of orifices 262 arranged at a position on the side wall proximate the top of the mold cavity for directing lubricating fluid from the side wall 211 toward the mold cavity. A second set of orifices may also be provided as shown at 264 as will be illustrated below. The first set of orifices 262 may be configured to direct a lubricating fluid toward the mold cavity to lubricate the casting surface (i.e., the surface surrounding the mold cavity along which the molten metal is solidified) of the side wall 211 during casting. The casting surface is the portion of the side wall that is in contact with the cast material, or facing the cast material and separated there from by the lubricating fluid. The casting surface may include a friction-reducing material, such as a coating or an insert, to supplement the lubricating properties of the lubricating fluid, such as a graphite material. The casting surface may be coated with a low-friction coating or may receive a low-friction material insert therein, such as a graphite insert, which may be replaceable and may not require lubricant.

An inner casting surface of graphite or another porous material may be used to function as a reservoir or sponge for grease or lubricant to distribute the grease or lubricant during the casting process, and potentially for multiple casts. This may enable grease or lubricant to be applied once before a cast or possible once before a sequence of casts. The inner casting surface may be flexible to enable the inner casting surface to flex with the wall of the mold to create the desired bore profile and resultant casting profile. The graphite or other inner casting surface material may be secured to the wall of the mold using adhesive or mechanical means, such as shrink fitting, fasteners, dovetail, or other grooves, for example. The cross section of the inner casting surface material may be constant or vary along the length or height of the material. For example, the material may be wider proximate the top of the inner casting surface and narrower proximate the bottom to account for bending stress. Further, the inner casting surface may be attached to the side wall in pieces or have grooves (e.g., vertical grooves) in one side of the material to enable the material to flex more easily and bend with the wall of the mold. FIG. 12, discussed further below, illustrates an example embodiment in which a side wall 211 includes a graphite 271 inner casting surface.

FIG. 6 depicts the back side of the side wall assembly 210 illustrating the top actuation plate 218 adjacent to top plate 216 and the bottom actuation plate 217 adjacent to the bottom plate 212. Also visible is the curvature 214 of the bottom plate visible below the back side of the side wall 211 as the side wall is illustrated in a substantially straight configuration. An end plate 320 attaches the top actuation plate 218 to the bottom actuation plate 217 such that they move together in unison through movement of actuation assembly 330. The actuation assembly may be any of a variety of mechanisms for providing the actuation necessary to achieve the motion described herein. The motion includes substantially linear motion along arrow 340, where the actuation plates 217 and 218 are configured to move along a longitudinal axis defined by the side wall assembly 210. The side wall 211 is attached to the actuation mechanism through force receiving members 310. This motion, as described further below, imparts a bending force on the side wall 211.

FIG. 7 illustrates the mechanism used to impart a bending motion to the side wall 211 using the actuation plates 217, 218 as actuated by actuation assembly 330. The actuation assembly may include a linear actuator, a ball screw mechanism, a rack and pinion mechanism, hydraulic piston, pneumatic piston, solenoid, or the like. While the illustrated embodiment of FIG. 6 illustrates a screw mechanism, which may be turned by hand, embodiments may generally include an automated actuation assembly to impart movement of the side walls 211. As shown herein, the actuation may be performed through generally linear movement and translated through actuation plates 217, 218 to cause a bend to be imparted on the side wall 211. The actuation may be automated through actuator means such as a solenoid, electric motor, hydraulic actuator, or the like. Optionally, actuation may be manual, as depicted in FIG. 6, including a turn-handle 330 which may be configured to move the actuation plates relative to the side wall assembly by virtue of a helical screw adjustment mechanism.

FIG. 7 shows a portion of the side wall 211 including a force receiving member 310 attached thereto at a contact point by arms 410 and brackets 420. The force receiving member 310 may be attached to the side wall at one or more contact points or locations along a height of the side wall 211, the height extending along an axis orthogonal to the image of FIG. 7. FIG. 8 illustrates a perspective view of the back of another portion of the side wall 211 including force receiving members 310 attached by arms 410 and brackets 420 to attachment points 450 defining contact regions for the force receiving members 310. As shown, a plurality of attachment points 450 are disposed along the back of the side wall 211 such that the force receiving members 310 can be repositioned along the length of the side wall 211 as needed to produce the necessary contour of the side wall 211 through an application of force through force receiving members 310. The attachment points provide a secondary function of securing the flexible bladders that form cooling fluid channels 460 and 465 as described further below using fasteners that may be use to attach the flexible bladders and to also attach the brackets 420 to the side wall 211 as appropriate. In the illustrated embodiment, there are two cooling fluid chambers 460 and 465, with attachment points 450 disposed on either side of the fluid channels and between the fluid channels. Attachment of the force receiving members 310 at three locations along the height of the side wall 211 provides an even distribution of forces applied to the force receiving members 310 at a position along the side wall from the top of the side wall to the bottom of the side wall, minimizing angular deflection of the sidewall. However, as described further below, forces may be applied distinctly from the top to the bottom of the force receiving members to induce a taper as appropriate according to some example embodiments.

While the illustrated embodiments described herein generally depict two fluid chambers (460 and 465), there may be more or fewer fluid chambers based on the desired design configuration. A single fluid chamber may be used in some embodiments to provide cooling fluid flow through the side wall 211. Optionally, more than two fluid chambers may be used, particularly in an embodiment in which different flow rates or pressures may be desirable through orifices associated with each of the fluid chambers. Similarly, while three attachment points are shown for each of the force receiving members 310, embodiments may include fewer or more attachment points. According to some embodiments, the force receiving members may be attached to the side wall only at a single location, while in other embodiments the force receiving members may be attached to the side wall at two, three, or more locations.

Referring back to FIG. 7, and with reference to FIG. 6, each of the actuation plates 217, 218 include an angled slot in which a respective end of the force receiving members 310 are disposed. This angled slot is represented by dashed line 440 of FIG. 7. The top plate 216 and bottom plate 212 also include slots in which respective ends of the force receiving members 310 are received. These slots are perpendicular to the line along which the side wall extends, and are represented by dashed line 430 of FIG. 7. FIG. 8 illustrates the end portion 314 of force receiving members 310 that are received in slots 440 of the actuation plates, while end portion 312 of the force receiving members 310 are received in a respective one of the top plate 216 or bottom plate 212 in slot 430. The end portions 312, 314 of the force receiving members 310 may include bearings or reduced friction surfaces in order to transmit forces between the slots 430, 440 and the force receiving members 310 as described herein, while reducing the frictional forces involved in the interface between the force receiving members 310 and the slots 430, 440.

According to the illustrated embodiment of FIG. 7, as the actuation plates 217, 218 are advanced simultaneously by actuation assembly 330 in the direction of arrow 445, the slot 440 also moves in the direction of arrow 445 with the actuation plates relative to force receiving members 310. The force receiving member 310 is held fixed in the y-axis (shown in FIGS. 7 and 9) by virtue of the force receiving member being received in the slots 430 of the top plate and bottom plate, restricting movement or displacement of the force receiving members to only along the x-axis. As the force receiving member is moved along slot 440 as the actuation plate is moved, the force receiving member 310 is displaced along the x-axis in slot 430 of the top plate and bottom plate. With the ends of the side wall 211 held substantially fixed relative to the x-axis, the movement of force receiving member 310 along slot 430 results in a displacement of the force receiving member 310 from its original position, and a bend is imparted on the side wall 211 as shown in FIG. 9 based on the displacement of the force receiving member, which may be exaggerated for ease of understanding. The forces between the actuation plates 217, 218 and the force receiving member 310 and the top 216 and bottom 212 plates and the force receiving member 310 are transmitted between the slots 440 and 430, respectively, and the bearing surfaces of the force receiving member 312, 314 shown in FIG. 8. This enables a smooth transition as the profile of the side wall 211 is changed during the casting process. This bend in side wall 211 enables the profile of the mold cavity to be dynamically adjusted during casting to reduce swelling of the butt of the ingot during the casting start-up phase.

While the above-described and illustrated embodiment includes actuation plates 217, 218 that move simultaneously and in synchronization, example embodiments described herein may provide an actuation mechanism that allows the top actuation plate 218 to be moved independently from the bottom actuation plate 217. Disconnecting the fixed relationship between the top actuation plate 218 and the bottom actuation plate 217 allows a curvature in the side wall 211 to be different between the top and bottom of the side wall, such as a tapered opening from a wider curve at the top of the side wall 211 to a narrower curve at the bottom of the side wall. Through disconnection of fixed relationship between the top actuation plate 218 and the bottom actuation plate 217, the displacement of the force receiving member 310 may be different from the top of the force receiving member to the bottom force receiving member. This additional degree of freedom may enable better control over the profile of the ingot cast from the mold by permitting differing displacement along the x-axis between the top of a side wall and the bottom of the side wall. The separate actuation may include any of the mechanisms described above duplicated for top and bottom actuation plates, or using a single actuation mechanism with an adjustment allowed between the actuation mechanism and one or both of the top 218 and bottom 217 actuation plates. Such an adjustment mechanism may be a mechanism that enables a length to be altered between the actuation mechanism and one or both of the actuation plates, thereby enabling an offset to be imparted between the top actuation plate and the bottom actuation plate.

Further, while the illustrated embodiment of FIGS. 3-9 depict actuation plates that engage each of the force receiving members, according to some embodiments, multiple actuation plates may be used for each of the top and bottom actuation plates to de-link the displacement of the force receiving members. As will be described further below, other mechanisms may be used to displace the force receiving members, and these mechanisms may also displace the force receiving members independently from one another. According to an embodiment implementing actuation plates as in FIGS. 3-9, multiple actuation plates may be used, with each actuation plate engaging one or more force receiving members, and each actuation plate may be independently actuatable to provide different displacements at each force receiving member as necessary to achieve the desired side wall profile during casting.

In response to a bend introduced in the side wall 211 of the mold cavity through displacement of the force receiving members 310 along the x-axis shown in FIGS. 7 and 9, the ends of the side wall will tend to pull in toward the middle of the side wall 211 as the wall is made of a material such as a metal which may be flexible, but resists elastic stretching. To accommodate this, the ends of the side wall 211 may be held in an arrangement that allows some degree of movement between different curvatures of the side wall 211 introduced by the mechanism described above. FIG. 10 illustrates such an arrangement, with the side wall 211 held between an end plate 480 and the fluid conduit block 260. The end plate 480 may be fastened at the top and bottom to a respective one of the top plate 216 and bottom plate 212, maintaining the end plate 480 in a fixed position relative to the side wall assembly 210. As the side wall 211 is moved between a straight profile and a curved profile, the ends of the side wall 211 may slide relative to the end plate 480 and fluid conduit block 260, enabling the necessary freedom of the ends of the side wall 211 to preclude unnecessary stresses on the bending middle portion of the side wall 211 between the two opposing ends. A force may be applied to the fluid conduit block 260 in the direction of the end plate 480 to capture the side wall 211 between the end plate 480 and the fluid conduit block 260. However, the fluid conduit block may be attached to the side wall 211 and move in concert with the side wall through the relatively small sliding movement of the side wall 211 during bending of the side wall. The end plate 480 may optionally be part of the end wall assembly, such that the end wall assembly is attached to the side wall assembly through the top plate 216 and the bottom plate 212 to form the mold cavity.

The illustrated embodiment of FIGS. 7-9 depict mechanisms by which a force is applied to the side wall 211 of the mold cavity to introduce a curvature to the side wall. These forces may be substantial, and the interface between the force receiving members 310 and the side wall 211 may experience relatively high stresses. In order to reduce or mitigate these stresses, a force distribution mechanism may be used to more evenly distribute the forces between the force receiving members 310 and the side wall 211. FIG. 11 illustrates an example embodiment of a bogie 411 force distribution member that may help mitigate stress concentration along the side wall 211. As shown, the bogie 411 rigidly connects pivot points 421 to the force receiving member 310, while being pivotally attached to both the force receiving member 310 and the side wall 211 via attachment points 450. This arrangement promotes force distribution from the force receiving member 310 along a portion of the sidewall 211 spanned by the bogie 411.

Also illustrated in FIG. 11 is a fixed position element 520, as described in greater detail below, but which remains at a fixed point within the side wall assembly 210 and applies a resistive force against the side wall 211 as the force receiving members 310 displace the side wall forming a curved side wall. The fixed position element 520 may be fixed only at the pivot point 521 such that the location of the fixed position element 520 remains constant during deformation of the side wall 211. However, according to some embodiments, the fixed position element 520 may pivot about axis 521 in order to better distribute forces along side wall 211. As shown, the fixed position element 520 is pivotable about axis 521, and includes arms 522 which are pivotably attached to fixed position block 525 at pivot points 523. The fixed position block 525 distributes forces from pivot point 521 to arms 522. Arms 522 distribute forces to attachment points 524. In this manner, forces between the pivot point 521 and the side wall 211 are distributed along the wall at attachment points 524 to reduce any stress concentrations along the wall which may lessen the likelihood of failure.

During the casting process, as material exits the mold cavity in response to the starter block 157 advancing downwardly as shown in FIG. 2, cooling of the material exiting the mold cavity is necessary to properly form the ingot 160. This cooling is expedited by the use of cooling fluid or coolant sprayed from orifices proximate the bottom of the side wall 211 in the direction of the material exiting the mold cavity. FIG. 12 illustrates a cut-away view of a side wall 211 including cooling fluid chambers 460 and 465 formed by flexible bladder 462. Also shown is a fluid chamber 261 formed into the back side of side wall 211 and separated from the fluid chambers 460 and 465. The flexible bladder 462 may be made of a silicone rubber with a nylon reinforcement. Silicone withstands high temperatures, particularly in short bursts, and sluffs molten aluminum with relative ease. The nylon reinforcement may keep the flexible bladder 462 from stretching which could create pressure variations and weaken the flexible bladder. Fluid chamber 261 is configured to carry lubricating fluid along the length of the side wall 211 and is in communication with the plurality of orifices 262 (of which a cross-section of one is shown in FIG. 12), which provides lubricating fluid to the face of the side wall 211. The lubricating fluid may be provided to the fluid chamber 261 at a relatively high pressure and release into the mold at a more uniform and lower pressure. The lubricating fluid exits the orifice 262 flowing generally downwardly along the casting surface of the side wall 211 rather than spraying outwardly from the side wall to provide a layer of lubrication between the casting and the side wall 211. Each of the plurality of orifices 262 for providing lubricating fluid to the face of side wall 211 may be configured to allow lubricating fluid to flow substantially evenly across the length of the side wall 211 using as many or as few lubricating fluid orifices as deemed appropriate for the size of the mold and the material to be cast. According to some embodiments, the orifices may be round and spaced apart along the side wall 211, while in other embodiments, the orifices may be elongate slots extending along the side wall 211. In an embodiment in which the orifices are elongate slots, the slots may be fed from fluid chamber 261 along pathways to the elongate slots disposed on the side wall 211. This may enable elongate slots to provide a "curtain" of lubricating fluid down the side wall as lubricating fluid exits the orifices.

As described above, the walls of the mold, including the illustrated side wall 211 and end walls, may include an inner casting material such as graphite. FIG. 12 illustrates such an example including a graphite inner casting material on the inner surface of the illustrated mold wall. This material may be adhered to the side wall 211 of the mold or mechanically attached through any available means. The illustrated inner casting material 271 extends along only a portion of the height of the side wall 211, but may extend the full height of the wall. Further, the inner casting material may include orifices there through to allow lubricant from orifices 262 through the inner casting material, or alternatively, the lubricant from orifices 262 may supply lubricant to the porous inner casting material which may then distribute the lubricant along the face of the inner casting material by virtue of the porous nature of the material.

FIG. 13 illustrates an example embodiment of an inner casting material 271 secured to the face of a mold wall 211. As shown, the inner casting material 271 includes a taper from a relatively wider thickness 272 proximate the top of the mold wall, and a narrower thickness 273 proximate the bottom of the mold wall 211. The example embodiment of FIG. 13 includes an inner casting material that extends from a location near the bottom of the mold wall 211 to the top of the mold wall. A ledge 274 is incorporated into the side wall 211 onto which the inner casting material 271 rests. This may enable the inner casting material 271 to be inserted from a top of the mold, and may reduce the reliance on the adhesive or mechanical fastening means between the inner casting material 271 and the mold wall 211 as the ledge 274 may support the inner casting material 271 and preclude movement of the inner casting material in a downward direction as material is cast through the mold.

As noted above, embodiments may include any number of cooling fluid chambers, where each cooling fluid chamber may feed one or more sets of orifices for providing cooling fluid to the cast part as it exits the mold. As shown in FIG. 12, cooling fluid chambers 460 and 465 may be configured to carry cooling fluid to two sets of cooling orifices 264 and 266. The side wall assembly may include baffles disposed between the cooling fluid chambers 460, 465, and the side wall 211, where baffle orifices may be sized and spaced to regulate fluid flow and pressure through the orifices 264 and 266. As shown in the embodiment of FIG. 12, a first set of baffle orifices 263 may regulate the cooling fluid flow through fluid passage 270 in the side wall 211 to a first set of orifices 266. A second set of baffle orifices 269 may regulate the cooling fluid flow through the second set of orifices 264. The use of a baffle plate 268 with orifices 263, 269 arranged therein may regulate the fluid flow and pressure, but may also enable fluid to flow from orifices 264, 266 in a laminar flow pattern along paths 265 and 267 based, at least in part, on the length of the fluid channel between the baffle plate 268 orifices 263 and 269 and orifices 266 and 264, respectively. While both orifices 264 and 266 are visible in the cut-away view of FIG. 12, along with the fluid flow paths for each, it is appreciated that both orifices and associated fluid flow pathways may not be visible in a physical section view. The cut-away view of FIG. 12 is provided for illustration and ease of understanding. While the orifices 264, 266 are illustrated as round, embodiments may include orifices 264, 266 which are elongate along the side wall 211. This may enable a different cooling fluid flow pattern from the orifices for cooling the cast part as it exits the mold.

According to an example embodiment, a baffle plate between the fluid flow chambers 460, 465 and the orifices 263, 269 may have slot-shaped apertures arranged vertically to reduce back pressure within the fluid chambers. This may allow less restrictive fluid flow to the orifices. However, embodiments may include flow restrictors disposed proximate the cooling orifices 265, 267 to promote even fluid flow among the orifices. Between the baffle plate and the restrictor, consistent, even fluid flow can be achieved through the orifices 265, 267.

According to the illustrated embodiment, fluid chamber 465 may be in fluid communication with cooling orifices 264, which may each be arranged at an angle with respect to the side wall 211. In the depicted embodiment, cooling orifices 265 are arranged at an angle of forty-five degrees relative to the side wall 211, as shown by arrow 265 indicating the direction of fluid exiting the first plurality of cooling orifices 264. The second plurality of cooling orifices 266 may be arranged to direct cooling fluid at a different angle as shown by arrow 267, which is illustrated at an angle of twenty-two degrees relative to the side wall 211. However, the second plurality of cooling orifices may be in fluid communication with cooling fluid chamber 460 rather than chamber 465. In order to supply cooling fluid from the cooling fluid chamber 460 to the plurality of orifices 266, a channel 270 may be machined or otherwise formed into the back face of the side wall 211, beneath the substrate 280 on which the cooling channels are supported. A channel 270 may be present for each of the second set of cooling orifices 266, or alternatively, channels 270 may exist at a plurality of locations along the length of the side wall 211 in cooperation with a channel closer to the second set of cooling orifices 266 extending longitudinally along the side wall 211 in a manifold arrangement.

According to the illustrated embodiment, the cooling fluid flow through each of the first plurality of orifices 264 and the second plurality of orifices 266 may be independently fed by a respective cooling fluid chamber 460, 465. This configuration enables a cooling profile to be generated according to the type of material being cast with the appropriate flow rates and spray patterns from the respective set of cooling orifices. The fluid conduit block described above with respect to FIG. 10 may include separate valves for controlling the cooling fluid flow to each of the cooling fluid chambers 460, 465. Separately controlled valves may enable independent flow regulation through the chambers and thus through the respective orifices to which the chambers are in fluid communication. Optionally, cooling fluid temperatures may be separately controlled to provide even further control over the cooling of the material exiting the mold. In order to accomplish this, the fluid conduit block may receive cooling fluid from two separate sources through two separate inlets, and control the flow from the separate inlets independently through each of the cooling fluid chambers 460, 465.

Further, while the arrows 265 and 267 depict a general direction of cooling fluid exiting the orifices 264, 266, respectively, the spray patterns and fluid flow rates may be designed according to a preferred spray pattern based on the cooling requirements of the material being cast. Cooling fluid may also be selected based on the cooling requirements of a particular material being cast. Such cooling fluid may include, for example, water, ethylene glycol, propylene glycol, Organic Acid Technology (OAT) cooling fluid, or other fluid suited for drawing heat away from the cast part. The angle of the cooling orifices 264 and 266 may each also be configured for a specific angle of impingement on the cast part, which may be at an angle to encourage laminar flow at the orifice exit and turbulent cast part cooling fluid flow as the cooling comes into contact with the cast part. The angle of flow from the cooling orifices 264 and 266 may be in the range of about 0 degrees (directed down, substantially parallel to the side of the cast part exiting the mold) to about 90 degrees (directed perpendicular to the side of the cast part exiting the mold toward the cast part). This angle may be established based on characteristics of the material to be cast in the mold, for example.

According to some embodiments, fluid conduit block 260, as shown in FIGS. 5 and 6, may be configured to control the fluid flow and pressure along the fluid channels in communication with the orifices 264, 266 according to established cooling needs of the material being cast through use of one or more valves, which may be disposed within the fluid conduit block 260. In an embodiment in which the fluid conduit block 260 includes a valve for each coolant fluid chamber, the fluid conduit block may be configured to independently control the flow and pressure along chambers 460 and 465 as needed. The fluid flow levels and pressures may be established based on an alloy composition, temperature of the material being cast, the speed at which the material is being cast (i.e., the speed at which the starting block descends into the casting pit), or other properties that affect the casting process. The fluid channels, as described further below, may be flexible such that flexing of the side wall 211 does not adversely affect or impact the integrity of the fluid channels.

Each of the fluid chambers 460 and 465 may be defined by a flexible bladder 462, such as a heat-resistant silicone or similar material. While a separate flexible bladder may be used to define each cooling fluid chamber, according to the illustrated embodiment, a single flexible bladder 462 is used to define both cooling fluid chambers 460, 465, where the flexible bladder webbing may be captured between fasteners 450 and their corresponding fastener holes within the side wall 211. The baffle plate 268 may also be captured between the flexible bladder webbing and the side wall 211 using those same fasteners. The flexible bladder webbing may also be adhered to the baffle plate 268 using an adhesive or high-temperature sealant. Optionally, the flexible bladder material may be fiber-reinforced, multi-material, or geometrically layered to improve life of the chambers 460, 465. The bladders may be flexible to accommodate the bending of side wall 211, though sufficiently resilient to enable a fluid pressure to be applied to the fluid within the chambers to facilitate the appropriate flow rate and spray pattern from the orifices 264, 266.

In addition to providing cooling fluid to the orifices 264, 266, the cooling fluid chambers 460 and 465 provide a cooling effect on the side wall 211 itself. Cooling fluid chambers 460 and 465 are arranged in a manner that facilitates heat extraction from the back face of the side wall 211 into the cooling fluid. This side wall cooling effect further reduces the temperature of the side wall 211 proximate the lubricating fluid channel 261 to avoid over heating the lubricating fluid which can result in premature evaporation or burning of the lubricating fluid. Cooling of the side wall 211 using cooling fluid chambers 460 and 465 further reduces the likelihood and degree to which lubricating fluid would burn or evaporate as it flows down along side wall 211 with the cast material.

Example embodiments have been described and illustrated herein as incorporating flexible side walls of a direct chill casting mold with fixed profile end walls. However, embodiments described herein with respect to the side walls may optionally include end wall assemblies having constructions similar to those of the sidewalls described herein. End walls that are sufficiently long to result in swell of the cast material during a start-up phase of the casting process, or in need of profile correction may be configured to be flexible in the same or a similar manner as described herein with respect to the side walls. The flexibility of end walls may further reduce swelling of the ingot butt during the start-up phase and may decrease waste while increasing the efficiency and output of a direct chill ingot casting mold.

The above described and illustrated example embodiments include a plurality of force applying members which, responsive to a force received, induce a bend in a side wall (or end wall) of a mold. FIG. 14 illustrates a representation of a side wall assembly 500 of a mold simplified for ease of understanding. As shown, the outline of a top plate 505 includes a side wall 511 disposed in a curved position. The curved position illustrated is achieved by to displacement of the force receiving elements 510 through forces applied to force receiving elements 510 in the direction of arrow 515. Embodiments described herein may optionally include fixed position elements that resist movement of the side wall 511. FIG. 14 depicts fixed position elements 520, which may be securely fastened to the top plate 505 and bottom plate (not shown) of side wall assembly 500. The fixed position elements 520, which are also depicted in FIG. 6, may be configured to ensure the appropriate curvature shape is achieved in response to the force applied to the force receiving elements 510. In this manner, fixed position elements 520 may limit maximum deformation of the side wall or end wall at a specific position along the wall.

The forces applied to the force receiving elements 510 may be different across a side wall. For example, as shown in FIG. 14, the three force receiving elements 510 may be configured to be displaced by a predefined amount from a straight configuration. This displacement will define the curvature imparted to the side wall 511. To achieve the desired curvature, the force applied at the middle force receiving element 510 may be different from those adjacent thereto. For example, applying an equal force to each force receiving element 510 may result in an arc with maximum displacement at the middle of the curve of the side wall 511, where the middle force receiving element is. However, the desired curvature of the wall may not include a maximum degree of curvature proximate the center of the wall 511, and may actually include a relatively straight section along all three force receiving elements. In such an embodiment, the displacement for each of the force receiving elements may be equal, while the middle force receiving element 510 may actually apply a force to the side wall 511 in a direction opposite arrow 515, opposing the curvature of the wall 511 to achieve a flatter curve in the middle of the side wall. As such, displacement of the force receiving members 510 may critical to establish the shape of the curve of the side wall, while the forces are applied as necessary to achieve the desired displacement.

The adjustment of the curvature of a side wall or end wall of a direct chill mold during the casting process may be controlled using a plurality of different methods. For example, a cast material may have a casting profile that dictates parameters with respect to casting speed (e.g., flow rate of the liquid cast material and descent speed of the starter block), the temperature of the liquid cast material entering the mold cavity, the flow rate/pressure of the cooling fluid through the cooling orifices, the flow rate/pressure of the lubricating fluid through the lubricating orifices, and a curvature profile for the material at each phase of the casting process. The curvature profile may be adjusted from a first position during the start-up phase of casting, to another curvature profile during the steady-state phase, to another curvature profile during the end phase, and any number of curvature profiles between these phases (e.g., a dynamic steady change between the different phases). In such an embodiment, a controller may dictate the shape of the curvature of the side walls and/or end walls throughout the casting process responsive to the phase of casting. Feedback of properties of the material being cast may not be necessary in such an embodiment.

According to some embodiments, the curvature profile of the walls of the mold may be determined based on a closed-loop feedback system. A controller may receive temperature information (e.g., of the liquid casting material, the cast material exiting the mold, mold temperature, etc.), casting speed (e.g., the speed of descent of the starter block and platform), dimensional information (e.g., dimensions of the cast part as it exits the mold cavity or a predefined distance below the mold cavity exit), stress and/or strain feedback, or other information related to the casting process, and use this information to establish the appropriate curvature profile of the wall. A plurality of sensors may be dispersed around the exit of the mold cavity, such as thermal sensors to detect the temperature of the casting exiting the mold, or distance sensors configured to measure the dimensions of the casting exiting the mold. These sensors may provide feedback to the controller to determine the appropriate curvature profile given the data with respect to the casting exiting the mold cavity.

While example embodiments described herein may be implemented to reduce or control butt swell of a cast part, example embodiments may optionally be implemented to preclude or mitigate cast parts getting stuck within the mold. For example, butt curl and excessively hot casting conditions of a cast part such as an ingot during the casting process may cause an interference fit of the cast part within the mold, where the mold walls (side walls, end walls, or both) become engaged by the cast part in a manner that precludes the cast part 160 from exiting the mold assembly 200 as the starter block 157 descends into the cast pit. These conditions which lead to an interference between mold and cast part may lead to catastrophic failure, such as a mold over flow if not quickly corrected or mitigated. During the steady-state portion of the casting process, various factors may contribute to a cast part becoming hung up in the mold, such as improper lubrication, abnormal cooling, or the like. During the end of the casting process, the cast part may experience "reduced head shrinkage" and the flexible walls of the mold of example embodiments may be controlled to accommodate this shrinkage. During the movement of the side walls of the mold, a binding condition may occur where the cast part becomes stuck or hung up in the mold. In each of these cases, while the causes may be different, a cast part may become stuck within the mold which can lead to catastrophic failure if not mitigated quickly.

Example embodiments described herein may provide feedback from the mold to a controller indicating when a condition arises where the cast part is stuck or hung up in the mold. The feedback to the controller may include one or both of two detected changes. A first change that occurs in the casting process when the cast part is hung up within the mold is that the casting fluid flow slows while movement of the starter block continues downward into the casting pit. The casting fluid flow is controlled by the control pin and spout orifice size based upon metal level feedback, such that if fluid flow is rising while the starter block continues to descend, it is an indication that the cast part may be stuck in the mold. The level of the molten metal in the mold may be maintained at a constant or near constant level during casting through feedback of the level in the mold to a valve, such as a control pin in a fluid flow tube, to adjust the flow according to the fluid level in the mold. If this fluid flow control has to reduce fluid flow to maintain fluid level unexpectedly, it may be a symptom of a cast part stuck in the mold cavity.

Similarly, if the casting fluid flow of a first mold cavity from among a plurality of mold cavities is different and slower than the remaining cavities, this may be an indication of a stuck cast part. A second change that may occur during casting that may be indicative of a cast part stuck in a mold is resistance or feedback experienced by the actuation mechanism that provides a curvature in the mold side walls. The mold side walls may be held in a predetermined position by the actuation mechanism, and when the cast part becomes stuck or hung up in the mold, a force may be applied by the cast part onto the mold walls. In the case of an electric actuation mechanism, the actuation mechanism may experience a rise or spike in amperage or current draw at the actuation mechanism indicating a resistive force opposing the actuation mechanism. This spike may be indicative of the hanging up of a cast part in the mold. In the case of a hydraulic actuation mechanism, a spike in pressure or current draw on a hydraulic pump may similarly be indicative of a cast part being hung up in the mold.

Still another mechanism to detect a cast part stuck in the mold may be through a weight or force on the starting block 157 and platform 159 (as shown in FIG. 2). During casting, the weight of the cast part will increase as the starting block descends into the casting pit due to the increase in material flowing into and exiting the mold cavity. If the weight decreases at any point during casting, it is an indication that the starting block no longer bears the full weight of the cast part. This may be an indication of a cast part stuck in the mold. The decrease in weight on the starting block may be detected by a force measurement transducer or other sensor on the starting block or on the platform. However, the reduced weight on the starting block may also be detected through the mechanism lowering the platform and starting block. For example, a hydraulic system used to lower the platform and starting block may control the lowering of the platform through controlling fluid flow from a chamber. Responsive to an unexpected change in fluid flow or fluid flow pressure, a controller of the system may determine that the weight on the starting block has decreased.

Responsive to an indication of a cast part being hung up in the mold, whether through one or both of an unexpected slowing of the casting fluid flow or a spike or increase in the hydraulic pressure or electrical current of the actuation mechanism, the controller may adjust the shape of the walls of the mold, such as the side walls, in an effort to cause the cast part to break free or separate from the mold, allowing lubricant to reach between the cast part and the mold walls. This change in shape may be caused by the controller actuating the actuation mechanism in such a way as to encourage the cast part to descend from the mold cavity along with the starting block down into the casting pit.

The actuation mechanism for inducing the appropriate curvature profile is described and illustrated above to include a pair of actuation plates and an actuation mechanism to move the actuation plates. However, other mechanisms may be employed to provide forces to the force receiving members to impart a curvature to the side walls or end walls of a mold. FIG. 15 illustrates such an example embodiment including the side wall assembly 500 arrangement of FIG. 14. The force receiving members 510 of FIG. 15 are connected to actuators 530 which can push or pull the force receiving members along the X-axis (e.g., in the direction of arrow 515 or opposite there to). The example embodiment of FIG. 15 may include actuators 530 that are linear actuators to push/pull the force receiving members 510. Actuators may optionally include rotational actuators that turn a gear, such as a pinion gear on a rack gear to impart a force to force receiving member 510, or a ball screw or worm gear that is rotated to impart a force on the force receiving member 510. As noted above, the actuators 530 may be able to independently control displacement of force receiving members 510 individually or in sub-sets.

In an example embodiment in which the actuators 530 function as described with respect to FIG. 15, multiple molds suspended within the same mold frame can benefit from equal and opposite forces applied by the actuators 530. FIG. 16 illustrates a plurality of mold assemblies 540 disposed within mold frame assembly 545. The mold assemblies 540 may be attached to the mold frame assembly 545 in any conventional manner to support the mold assemblies within the frame as the mold frame assembly transitions between a substantially vertical position in which the mold assemblies are positioned on-end, to the substantially horizontal position in which the mold assemblies are suspended during casting using the mold cavities 550. As shown, the three illustrated mold assemblies 540 include two pairs of adjacent side wall assemblies 560. During casting, each of the mold assemblies are ideally at the same stage of the casting phase at the same time due to a uniform material being cast in each of the mold cavities 550 and a common platform on which the three starter-blocks for the molds are descending simultaneously. As such, the curvature profile of the side walls of each mold should be the same. The adjacent side wall assemblies 560 would then be providing equal and opposite forces to their respective side walls.

FIG. 17 illustrates an example embodiment of a pair of adjacent side wall assemblies 560 from an adjacent pair of mold assemblies. In such an embodiment, the benefits of the equal and opposite applied forces can be realized. In the embodiment of FIG. 17, actuators 530 can be disposed between the pair of adjacent side wall assemblies 560 and configured to apply forces that are equal and opposite to an opposing pair of force receiving elements 510. In this manner, the actuators remain in a neutral-force condition regardless of force applied to the force receiving elements 510. This enables the support structures that support these actuators to be less substantial and not require reinforcing superstructure to preclude the mold assemblies from bending based on the forces exerted by the actuators 530. While FIG. 17 illustrates shared actuators 530, example embodiments may include individual actuators for each force receiving member 510 of each side wall assembly, but may enable coupling between corresponding actuators from adjacent side wall assemblies 560. This enables the side wall assemblies to cooperate to be force-neutral while still producing the necessary curvature profile in the side wall. Side wall assemblies that do not have an adjacent side wall assembly may require increased structural support relative to those side wall assemblies that are adjacent to other side wall assemblies. The increased structural support may be modular and removable, while the coupling of adjacent actuators may be interchangeable to enable molds to be placed within a frame without regard to their order, and enable coupling between any pair of adjacent side wall assemblies and reinforcing of any non-adjacent side wall assemblies.

The dynamically adjustable side walls of example embodiments described herein may be used to establish the profile of the cast part as it exits the mold cavity and cools. However, according to some embodiments, the dynamically adjustable side walls may optionally be used to aid in aligning the starting block to the mold cavity. Alignment of the starting block with the mold cavity is important to ensure no casting fluid leaks at the start to the casting process. While a mold frame may be moved to align with a starting block through, for example, electric, pneumatic or hydraulic actuator means, embodiments described herein may use the dynamic flexibility of the mold side walls to align the mold cavity to the starting block. The starting block 157 may be positioned on a platform 159. The interface between the starting block 157 and the platform 159 may be a reduced friction interface, such as through use of a lubricating material (e.g., grease, oil, graphite, etc.) or using an air cushion with air fed through the platform to between the platform 159 and the starting block 157. One or more alignment features may extend below the mold cavity to be used as guides to guide the starting block 157 into engagement with the mold cavity. Prior to casting, as the platform is raised to engage the starting block 157 with the mold cavity, or as the mold is lowered into engagement with the starting block, the side walls of the mold cavity may be adjusted to open the mold cavity. Opening of the mold cavity using the dynamically adjusted side walls may provide a larger area into which the starting block 157 may be received, helping ease alignment.

Bringing the starting block into engagement with the mold cavity may be aided by alignment features of the mold, and once the starting block 157 is within the mold cavity, the dynamically adjusted side walls may be adjusted to a smaller opening to provide proper clearance with the starting head for cast start. In the event the starting block is not properly aligned or centered within the mold cavity, the adjustment of the side walls of the mold cavity may move the starting block such that it is centered within the mold cavity. The reduced friction surface between the starting block 157 and the platform 159 may facilitate this movement. Through this mechanism, alignment between the starting block 157 and the mold cavity may be more easily achieved.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A wall of a direct chill casting mold comprising:

a longitudinally extending body extending along a length between a first end and a second end;

a graphite insert defining, at least in part, a casting face of the wall; and one or more force receiving members attached to the longitudinally extending body, wherein the one or more force receiving members is configured to impart a bend to the longitudinally extending body between the first end and the second end relative to a straight line between the first end and the second end, and wherein the graphite insert maintains contact with the longitudinally extending body along its length as the bend is imparted to the longitudinally extending body.

2. The wall of a direct chill casting mold according to claim 1, wherein the graphite insert is mechanically attached to the longitudinally extending body using one or more fasteners.

3. The wall of a direct chill casting mold according to claim 1, wherein the graphite insert is attached to the longitudinally extending body using an adhesive.

4. The wall of a direct chill casting mold according to claim 1, wherein the graphite insert is attached to the longitudinally extending body by shrink fitting.

5. The wall of a direct chill casting mold according to claim 1, wherein the graphite insert has a first thickness proximate a top edge of the longitudinally extending body and a second thickness proximate a bottom edge of the longitudinally extending body, wherein the first thickness is greater than the second thickness.

6. The wall of a direct chill casting mold according to claim 1, further comprising a ledge extending along the longitudinally extending body proximate a bottom edge of the longitudinally extending body, wherein the ledge supports the graphite insert.

7. The wall of a direct chill casting mold according to claim 1, wherein the graphite insert is secured to an inner face of the longitudinally extending body by interfacing grooves between the graphite insert and the inner face.

8. The wall of a direct chill casting mold according to claim 1, wherein the graphite insert is coated with and absorbs a lubricating fluid.

9. The wall of a direct chill casting mold according to claim 1, wherein the graphite insert comprises a casting face and a contact face, wherein the contact face contacts the longitudinally extending body along its length, wherein the graphite insert comprises one or more grooves in the contact face to facilitate bending of the graphite insert in congruence with the longitudinally extending body.

10. The wall of a direct chill casting mold according to claim 9, wherein the one or more grooves extend transverse to the longitudinally extending body.

11. The wall of a direct chill casting mold according to claim 1, wherein the bend imparted to the longitudinally extending body comprises a compound curvature.

12. The wall of a direct chill casting mold according to claim 1 wherein the one or more force receiving members comprises at least two force receiving members attached to corresponding at least two contact regions, wherein each of the at least two contact regions is configured to be displaced relative to a straight line between the first end and the second end of the longitudinally extending body generating a respective displacement at each of the at least two contact regions in response to receiving a respective force applied to each of the at least two force receiving members.

13. The wall of a direct chill casting mold according to claim 12, wherein the respective displacement at a first of the at least two contact regions is different from a displacement at a second of the at least two contact regions, and wherein a respective force at each of the at least two contact regions changes curvature of the longitudinally extending body.

14. A wall of a direct chill casting mold comprising:

a longitudinally extending body extending along a length between a first end and a second end;

an inner face extending from proximate the first end to proximate the second end;

a graphite insert secured to the inner face and extending from proximate the first end to proximate the second end, the graphite insert defining a portion of a mold cavity; and an outer surface opposite the inner face;

wherein at least one force applied to the outer surface imparts a bend to the longitudinally extending body relative to a straight line between the first end and the second end, and wherein the graphite insert bends in congruence with the longitudinally extending body.

15. The wall of a direct chill casting mold of claim 14, further comprising:

at least one cooling chamber extending along the longitudinally extending body, wherein cooling fluid flowing through the at least one cooling chamber draws heat from a casting through the graphite insert and through the longitudinally extending body to maintain the graphite insert below a predetermined temperature.

16. The wall of a direct chill casting mold of claim 14, wherein the graphite insert is configured to be displaced along an axis substantially orthogonal to the inner face in response to the at least one force applied to the outer surface.

17. The wall of a direct chill casting mold of claim 14, wherein the graphite insert is mechanically coupled to the inner face using one or more fasteners.

18. The wall of a direct chill casting mold according to claim 14, wherein the graphite insert is attached to the inner face using an adhesive.

19. The wall of a direct chill casting mold according to claim 14, wherein the graphite insert has a first thickness proximate a top edge of the inner face and a second thickness proximate a bottom edge of the inner face, wherein the first thickness is greater than or equal to the second thickness.

20. A graphite insert for a wall of a direct chill casting mold comprising:

a longitudinally extending graphite body;

a casting surface extending along a first side of the graphite body; and a back surface extending along a second side of the graphite body, opposite the first side;

wherein the back surface is configured to be secured to a wall of a direct chill casting mold, wherein the back surface maintains contact with the direct chill casting mold and bends in congruence with the wall of the direct chill casting mold as the wall bends along its length between a first end and a second end.

* * * * *